US009771520B2

(12) United States Patent
Medoff et al.

(10) Patent No.: US 9,771,520 B2
(45) Date of Patent: Sep. 26, 2017

(54) PROCESSING HYDROCARBON-CONTAINING MATERIALS

(71) Applicant: XYLECO, INC., Woburn, MA (US)

(72) Inventors: Marshall Medoff, Brookline, MA (US); Thomas Craig Masterman, Rockport, MA (US)

(73) Assignee: XYLECO, INC., Wakefield, MA (US)

( * ) Notice: Subject to any disclaimer, the term of this patent is extended or adjusted under 35 U.S.C. 154(b) by 0 days.

(21) Appl. No.: 14/978,497

(22) Filed: Dec. 22, 2015

(65) Prior Publication Data

US 2016/0108321 A1 Apr. 21, 2016

Related U.S. Application Data

(63) Continuation of application No. 13/293,985, filed on Nov. 10, 2011, now Pat. No. 9,243,188, which is a continuation of application No. PCT/US2010/035331, filed on May 18, 2010.

(60) Provisional application No. 61/179,995, filed on May 20, 2009, provisional application No. 61/218,832, filed on Jun. 19, 2009, provisional application No. 61/226,877, filed on Jul. 20, 2009.

(51) Int. Cl.

| | |
|---|---|
| ***B01F 5/00*** | (2006.01) |
| ***C10G 1/04*** | (2006.01) |
| ***B01F 5/02*** | (2006.01) |
| ***B01F 5/10*** | (2006.01) |
| ***C10G 1/00*** | (2006.01) |
| ***E21B 43/24*** | (2006.01) |

(52) U.S. Cl.

CPC ..... *C10G 1/047* (2013.01); *B01F 5/0212* (2013.01); *B01F 5/10* (2013.01); *C10G 1/00* (2013.01); *E21B 43/24* (2013.01)

(58) Field of Classification Search

CPC ..... A23K 10/00; A23K 50/48; B01F 13/1025; B01F 13/1033; B01F 5/0212; B01F 5/104; B01F 5/10

USPC ..... 366/603, 262, 264, 269, 270, 163.2, 366/168.1, 171.1, 172.2, 174.1, 175.2

See application file for complete search history.

(56) References Cited

U.S. PATENT DOCUMENTS 3,171,635 A 3/1965 Haentjens et al.
3,285,581 A * 11/1966 Moore ..... A23N 17/007 366/157.3
4,055,673 A * 10/1977 Mueller ..... B02B 1/06 366/603

(Continued)

FOREIGN PATENT DOCUMENTS

CN 2502777 7/2002

OTHER PUBLICATIONS

Office Action—Corresponding Canadian Application No. 2,761,305, dated Apr. 4, 2016, 6 pages.

*Primary Examiner* — Tony G Soohoo
*Assistant Examiner* — Anshu Bhatia
(74) *Attorney, Agent, or Firm* — Leber IP Law; Dennis Haszko

(57) ABSTRACT

Hydrocarbon-containing feedstocks are processed to produce useful intermediates or products, such as fuels. For example, systems are described that can process a petroleum-containing feedstock, such as oil sands, oil shale, tar sands, and other naturally-occurring and synthetic materials that include both hydrocarbon components and solid matter, to obtain a useful intermediate or product.

7 Claims, 21 Drawing Sheets

(56) References Cited

U.S. PATENT DOCUMENTS

| | | | | | |
|---|---|---|---|---|---|
| 4,058,495 | A * | 11/1977 | Serratore | C08K 5/05 | 524/733 |
| 4,169,047 | A * | 9/1979 | Wilson | B03D 1/20 | 209/164 |
| 4,337,152 | A | 6/1982 | Lynch | | |
| 4,363,784 | A * | 12/1982 | Hilbig | C08B 17/06 | 422/134 |
| 4,419,214 | A | 12/1983 | Balint et al. | | |
| 4,426,450 | A | 1/1984 | Donofrio | | |
| 4,846,053 | A * | 7/1989 | Lane | A23N 17/004 | 366/603 |
| 5,055,204 | A | 10/1991 | Bogart | | |
| 5,294,315 | A * | 3/1994 | Cooper | A62D 3/15 | 204/158.2 |
| 5,593,890 | A | 1/1997 | Flores-Cotera et al. | | |
| 5,615,696 | A | 4/1997 | Lawler | | |
| 5,620,250 | A * | 4/1997 | Chilcoat | B01F 5/0218 | 239/233 |
| 6,557,835 | B2 * | 5/2003 | Dijk | B01F 3/04539 | 210/220 |
| 7,025,874 | B2 | 4/2006 | Chan et al. | | |
| 2002/0134704 | A1 | 9/2002 | Mitchell et al. | | |
| 2004/0065589 | A1 | 4/2004 | Jorgensen | | |
| 2005/0103684 | A1 | 5/2005 | Evans | | |
| 2006/0050604 | A1 * | 3/2006 | Brunazzi | A01K 5/001 | 366/20 |
| 2009/0090654 | A1 | 4/2009 | Duyvesteyn et al. | | |
| 2009/0250383 | A1 | 10/2009 | Young et al. | | |

* cited by examiner

PROCESSING HYDROCARBON-CONTAINING MATERIALS

RELATED APPLICATIONS

This application is a continuation of U.S. patent application Ser. No. 13/293,985, filed Nov. 10, 2011, which is a continuation of PCT Application Serial No. PCT/US2010/035331, filed May 18, 2010, which claimed priority to U.S. Provisional Application Ser. No. 61/179,995, filed May 20, 2009, U.S. Provisional Application Ser. No. 61/218,832, filed Jun. 19, 2009, and U.S. Provisional Application Ser. No. 61/226,877, filed Jul. 20, 2009. The complete disclosure of each of these applications is hereby incorporated by reference herein.

BACKGROUND

Processing hydrocarbon-containing materials can permit useful intermediates or products to be extracted from the materials. Natural hydrocarbon-containing materials can include a variety of other substances in addition to hydrocarbons.

SUMMARY

Systems and methods are disclosed herein for processing a wide variety of different hydrocarbon-containing materials, such as light and heavy crude oils, natural gas, bitumen, coal, and such materials intermixed with and/or adsorbed onto a solid support, such as an inorganic support. In particular, the systems and methods disclosed herein can be used to process (e.g., crack, convert, isomerize, reform, separate) hydrocarbon-containing materials that are generally thought to be less easily processed, including oil sands, oil shale, tar sands, and other naturally-occurring and synthetic materials that include both hydrocarbon components and solid matter (e.g., solid organic and/or inorganic matter).

Such materials can be especially difficult to mix with liquids, e.g., with water or a solvent system during processing. For example, if the materials are low density, the materials tend to float to the surface of the liquid, or if the materials are high density they tend to sink to the bottom of the mixing vessel, rather than being dispersed. In some cases, the materials can be hydrophobic, highly crystalline, or otherwise difficult to wet. At the same time, it is desirable to process the feedstock in a relatively high solids level dispersion, for efficiency and in order to obtain a high final concentration of the desired product after processing.

The inventors have found that dispersion of a feedstock in a liquid mixture can be enhanced, and as a result in some cases the solids level of the mixture can be increased, by the use of certain mixing techniques and equipment. The mixing techniques and equipment disclosed herein also enhance mass transfer. In particular, jet mixing techniques, including for example jet aeration and jet flow agitation, have been found to provide good wetting, dispersion and mechanical disruption. By increasing the solids level of the mixture, the process can proceed more rapidly, more efficiently and more cost-effectively, and the resulting concentration of the intermediate or product can be increased.

In some implementations, the process further includes treating the feedstock to facilitate recovery of the hydrocarbon. For example, exposure of the materials to particle beams (e.g., beams that include ions and/or electrons and/or neutral particles) or high energy photons (e.g., x-rays or gamma rays) can be used to process the materials. Particle beam exposure can be combined with other techniques such as sonication, mechanical processing, e.g., comminution (for example size reduction), temperature reduction and/or cycling, pyrolysis, chemical processing (e.g., oxidation and/or reduction), and other techniques to further break down, isomerize, or otherwise change the molecular structure of the hydrocarbon components, to separate the components, and to extract useful materials from the components (e.g., directly from the components and/or via one or more additional steps in which the components are converted to other materials). Radiation may be applied from a device that is in a vault. Methods of treating hydrocarbon-containing materials are described in detail in U.S. patent application Ser. Nos. 12/417,786 and 12/417,699, both of which were filed on Apr. 3, 2009, the complete disclosures of which are incorporated herein by reference.

The systems and methods disclosed herein also provide for the combination of any hydrocarbon-containing materials described herein with additional materials including, for example, solid supporting materials. Solid supporting materials can increase the effectiveness of various material processing techniques. Further, the solid supporting materials can themselves act as catalysts and/or as hosts for catalyst materials such as noble metal particles, e.g., rhodium particles, platinum particles, and/or iridium particles. The catalyst materials can increase still further the rates and selectivity with which particular intermediates or products are obtained from processing the hydrocarbon-containing materials. Such additional materials and their use in processing are described in the above-incorporated U.S. patent application Ser. No. 12/417,786.

Many of the intermediates or products obtained by the methods disclosed herein, such as petroleum products, can be utilized directly as a fuel or as a blend with other components for powering cars, trucks, tractors, ships or trains. The hydrocarbon products can be further processed via conventional hydrocarbon processing methods. Where hydrocarbons were previously associated with solid components in materials such as oil sands, tar sands, and oil shale, the liberated hydrocarbons are flowable and are therefore amenable to processing in refineries.

In one aspect, the invention features a method that includes processing a hydrocarbon-containing feedstock by mixing the feedstock with a liquid medium in a vessel, using a jet mixer.

Some embodiments include one or more of the following features. The jet mixer may include, for example, a jet-flow agitator, a jet aeration type mixer, or a suction chamber jet mixer. If a jet aeration type mixer is used, it may be used without injection of air through the mixer. For example, if the jet aeration type mixer includes a nozzle having a first inlet line and a second inlet line, in some cases both inlet lines are supplied with a liquid. In some cases, mixing comprises adding the feedstock to the liquid medium in increments and mixing between additions. The mixing vessel may be, for example, a tank, rail car or tanker truck. The method may further include adding an emulsifier or surfactant to the mixture in the vessel.

In some instances, the vessel is or includes a conduit or other structure or carrier for the feedstock. For example, a jet mixer may be disposed in a conduit, e.g., between processing areas. In this case, the jet mixer can serve the dual purpose of mixing and conveying the mixture from one area to another. Additional jet mixers can be disposed in other areas, e.g., in one or more processing tanks, if desired. In some cases, the vessel can be a continuous loop of pipe, tubing, or other structure that defines a bore or lumen, and jet mixing can take place within this loop.

In another aspect, the invention features processing a hydrocarbon-containing feedstock by mixing the feedstock with a liquid medium in a vessel, using a mixer that produces generally toroidal flow within the vessel.

In some embodiments, the mixer is configured to limit any increase in the overall temperature of the liquid medium to less than 5° C. over the course of mixing. This aspect may also include, in some embodiments, any of the features discussed above.

In another aspect, the invention features an apparatus that includes a tank, a jet mixer having a nozzle disposed within the tank, and a delivery device configured to deliver a hydrocarbon-containing feedstock to the tank.

Some embodiments include one or more of the following features. The jet mixer can further include a motor, and the apparatus can further include a device configured to monitor the torque on the motor during mixing. The apparatus can also include a controller that adjusts the operation of the feedstock delivery device based on input from the torque-monitoring device.

All publications, patent applications, patents, and other references mentioned herein or attached hereto are incorporated by reference in their entirety for all that they contain.

DETAILED DESCRIPTION

Figure 1:
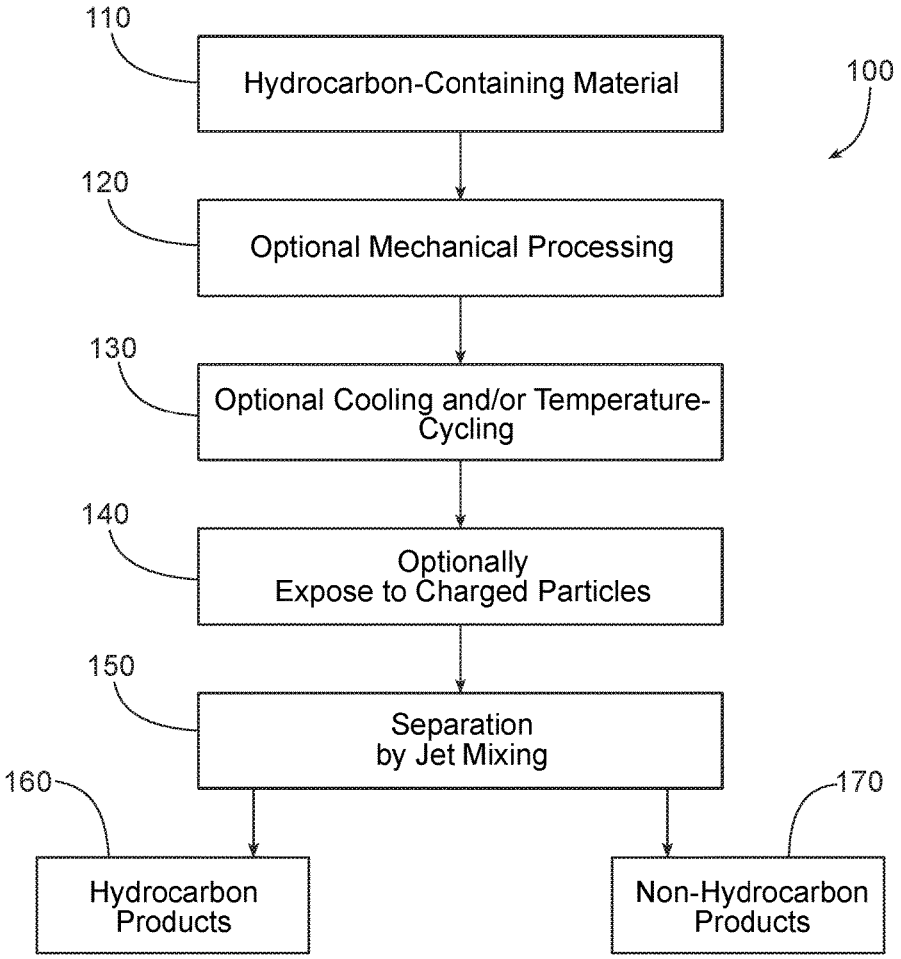
FIG. 1 is a schematic diagram showing a sequence of steps for processing hydrocarbon-containing materials.

FIG. 1 shows a schematic diagram of a technique 100 for processing hydrocarbon-containing materials such as oil sands, oil shale, tar sands, and other materials that include hydrocarbons intermixed with solid components such as rock, sand, clay, silt, and/or solid organic material. These materials may be in their native form, or may have been previously treated, for example treated in situ with radiation as described below. In a first step of the sequence shown in FIG. 1, the hydrocarbon-containing material 110 can be subjected to one or more optional mechanical processing steps 120. The mechanical processing steps can include, for example, grinding, crushing, agitation, centrifugation, rotary cutting and/or chopping, shot-blasting, and various other mechanical processes that can reduce an average size of particles of material 110, and initiate separation of the hydrocarbons from the remaining solid matter therein. In some embodiments, more than one mechanical processing step can be used. For example, multiple stages of grinding can be used to process material 110. Alternatively, or in addition, a crushing process followed by a grinding process can be used to treat material 110. Additional steps such as agitation and/or further crushing and/or grinding can also be used to further reduce the average size of particles of material 110.

In a second step 130 of the sequence shown in FIG. 1, the hydrocarbon-containing material 110 can be subjected to one or more optional cooling and/or temperature-cycling steps. In some embodiments, for example, material 110 can be cooled to a temperature at and/or below a boiling temperature of liquid nitrogen. More generally, the cooling and/or temperature-cycling in step 130 can include, for example, cooling to temperatures well below room temperature (e.g., cooling to 10° C. or less, 0° C. or less, −10° C. or less, −20° C. or less, −30° C. or less, −40° C. or less, −50° C. or less, −100° C. or less, −150° C. or less, −200° C. or less, or even lower temperatures). Multiple cooling stages can be performed, with varying intervals between each cooling stage to allow the temperature of material 110 to increase. The effect of cooling and/or temperature-cycling material 110 is to disrupt the physical and/or chemical structure of the material, promoting at least partial dissociation of the hydrocarbon components from the non-hydrocarbon components (e.g., solid non-hydrocarbon materials) in material 110. Suitable methods and systems for cooling and/or temperature-cycling of material 110 are disclosed, for example, in U.S. Provisional Patent Application Ser. No. 61/081,709, filed on Jul. 17, 2008, and U.S. Ser. No. 12/502,629, filed Jul. 14, 2009, the entire contents of which are incorporated herein by reference.

In a third step 140 of the sequence of FIG. 1, the hydrocarbon-containing material 110 can be exposed to charged particles or photons, such as photons having a wavelength between about 0.01 nm and 280 nm. In some embodiments, the photons can have a wavelength between, e.g., 100 nm to 280 nm or between 0.01 nm to 10 nm, or in some cases less than 0.01 nm. The charged particles interact with material 110, causing further disassociation of the hydrocarbons therein from the non-hydrocarbon materials, and also causing various hydrocarbon chemical processes, including chain scission, bond-formation, and isomerization. These chemical processes convert long-chain hydrocarbons into shorter-chain hydrocarbons, many of which can eventually be extracted from material 110 as products and used directly for various applications. The chemical processes can also lead to conversion of various products into other products, some of which may be more desirable than others. For example, through bond-forming reactions, some short-chain hydrocarbons may be converted to medium-chain-length hydrocarbons, which can be more valuable products. As another example, isomerization can lead to the formation of straight-chain hydrocarbons from cyclic hydrocarbons. Such straight-chain hydrocarbons may be more valuable products than their cyclized counterparts.

By adjusting an average energy of the charged particles and/or an average current of the charged particles, the total amount of energy delivered or transferred to material 110 by the charged particles can be controlled. In some embodiments, for example, material 110 can be exposed to charged particles so that the energy transferred to material 110 (e.g., the energy dose applied to material 110) is 0.3 Mrad or more (e.g., 0.5 Mrad or more, 0.7 Mrad or more, 1.0 Mrad or more, 2.0 Mrad or more, 3.0 Mrad or more, 5.0 Mrad or more, 7.0 Mrad or more, 10.0 Mrad or more, 15.0 Mrad or more, 20.0 Mrad or more, 30.0 Mrad or more, 40.0 Mrad or more, 50.0 Mrad or more, 75.0 Mrad or more, 100.0 Mrad or more, 150.0 Mrad or more, 200.0 Mrad or more, 250.0 Mrad or more, or even 300.0 Mrad or more).

In general, electrons, ions, photons, and combinations of these can be used as the charged particles in step 140 to process material 110. A wide variety of different types of ions can be used including, but not limited to, protons, hydride ions, oxygen ions, carbon ions, and nitrogen ions. These charged particles can be used under a variety of conditions; parameters such as particle currents, energy distributions, exposure times, and exposure sequences can be used to ensure that the desired extent of separation of the hydrocarbon components from the non-hydrocarbon components in material 110, and the extent of the chemical conversion processes among the hydrocarbon components, is reached. Suitable systems and methods for exposing material 110 to charged particles are discussed, for example, in U.S. Ser. No. 12/417,699, filed Apr. 3, 2009, U.S. Ser. No. 12/486,436, filed Oct. 5, 2009, as well as the following U.S. Provisional Patent Applications: Ser. No. 61/049,406, filed on Apr. 30, 2008; Ser. No. 61/073,665, filed on Jun. 18, 2008; and Ser. No. 61/073,680, filed on Jun. 18, 2008. The entire contents of each of the foregoing applications is incorporated herein by reference. In particular, charged particle systems such as inductive linear accelerator (LINAC) systems can be used to deliver large doses of energy (e.g., doses of 50 Mrad or more) to material 110.

In the final step of the processing sequence of FIG. 1, the processed material 110 is subjected to a separation step 150, which separates the hydrocarbon products 160 and the non-hydrocarbon products 170. The separation step includes an extraction process that involves agitating the material 110. For example, tar sands are processed using a hot water extraction process. After mining, the tar sands are transported to an extraction plant, where the hot water extraction process separates bitumen from sand, water and minerals. Hot water is added to the sand, and the resulting slurry is agitated. The combination of hot water and agitation releases bitumen from the oil sand in the form of droplets. Air bubbles attach to the bitumen droplets, causing the droplets to float to the top of the separation tank. The bitumen is then skimmed off and processed to remove residual water and solids. During this extraction process, agitation is performed using the jet mixing techniques discussed below.

A wide variety of other processing steps can optionally be used to further separate and refine the products. Exemplary processes include, but are not limited to, distillation, centrifugation and filtering.

The processing sequence shown in FIG. 1 is a flexible sequence, and can be modified as desired for particular materials 110 and/or to recover particular hydrocarbon products 160. For example, the order of the various steps can be changed in FIG. 1. Further, additional steps of the types shown, or other types of steps, can be included at any point within the sequence, as desired. For example, additional mechanical processing steps, cooling/temperature-cycling steps, particle beam exposure steps, and/or separation steps can be included at any point in the sequence. Further, other processing steps such as sonication, chemical processing, pyrolysis, oxidation and/or reduction, and radiation exposure can be included in the sequence shown in FIG. 1 prior to, during, and/or following any of the steps shown in FIG. 1. Many processes suitable for inclusion in the sequence of FIG. 1 are discussed, for example, in PCT Publication No. WO 2008/073186 (e.g., throughout the Detailed Description section).

Suitable liquids that can be added to material 110, e.g., during extraction, include, for example, water, various types of liquid hydrocarbons (e.g., hydrocarbon solvents), and other common organic and inorganic solvents.

Agitation

Jet Mixing Characteristics

Various types of mixing devices which may be used during hydrocarbon processing are described below. Other mixing devices having similar characteristics may be used. Suitable mixers have in common that they produce high velocity circulating flow, for example flow in a toroidal or elliptical pattern. Generally, preferred mixers exhibit a high bulk flow rate. Preferred mixers provide this mixing action with relatively low energy consumption. It is also preferred in some cases that the mixer produce relatively low shear and avoid heating of the liquid medium. As will be discussed in detail below, some preferred mixers draw the mixture through an inlet into a mixing element, which may include a rotor or impeller, and then expel the mixture from the mixing element through an outlet nozzle. This circulating action, and the high velocity of the jet exiting the nozzle, assist in dispersing material that is floating on the surface of the liquid or material that has settled to the bottom of the tank, depending on the orientation of the mixing element. Mixing elements can be positioned in different orientations to disperse both floating and settling material, and the orientation of the mixing elements can in some cases be adjustable.

For example, in some preferred mixing systems the velocity $v_o$ of the jet as meets the ambient fluid is from about 2 to 300 m/s, e.g., about 5 to 150 m/s or about 10 to 100 m/s. The power consumption of the mixing system may be about 20 to 1000 KW, e.g., 30 to 570 KW, 50 to 500 KW, or 150 to 250 KW for a 100,000 L tank. It is generally preferred that the power usage be low for cost-effectiveness.

Figure 17:
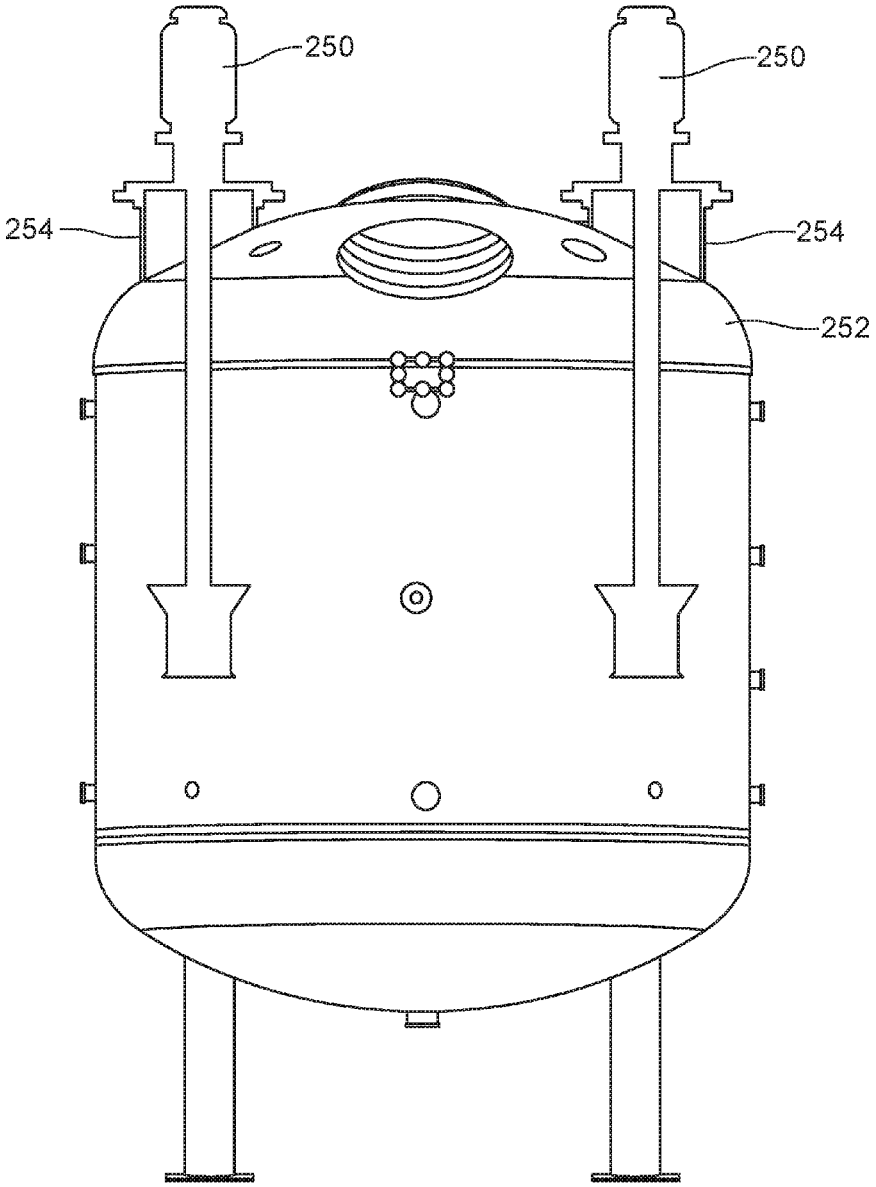
FIG. 17 is a cross-sectional view of a tank having a domed bottom and two jet mixers extending into the tank from above.

Jet mixing involves the discharge of a submerged jet, or a number of submerged jets, of high velocity liquid into a fluid medium, in this case the mixture of feedstock and liquid medium. The jet of liquid penetrates the fluid medium, with its energy being dissipated by turbulence and some initial heat. This turbulence is associated with velocity gradients (fluid shear). The surrounding fluid is accelerated and entrained into the jet flow, with this secondary entrained flow increasing as the distance from the jet nozzle increases. The momentum of the secondary flow remains generally constant as the jet expands, as long as the flow does not hit a wall, floor or other obstacle. The longer the flow continues before it hits any obstacle, the more liquid is entrained into the secondary flow, increasing the bulk flow in the tank or vessel. When it encounters an obstacle, the secondary flow will lose momentum, more or less depending on the geometry of the tank, e.g., the angle at which the flow impinges on the obstacle. It is generally desirable to orient the jets and/or design the tank so that hydraulic losses to the tank walls are minimized. For example, it may be desirable for the tank to have an arcuate bottom (e.g., a domed headplate), and for the jet mixers to be oriented relatively close to the sidewalls, as shown in FIG. 17. The tank bottom (lower head plate) may have any desired domed configuration, or may have an elliptical or conical geometry.

Jet mixing differs from most types of liquid/liquid and liquid/solid mixing in that the driving force is hydraulic rather than mechanical. Instead of shearing fluid and propelling it around the mixing vessel, as a mechanical agitator does, a jet mixer forces fluid through one or more nozzles within the tank, creating high-velocity jets that entrain other fluid. The result is shear (fluid against fluid) and circulation, which mix the tank contents efficiently.

Figure 2:
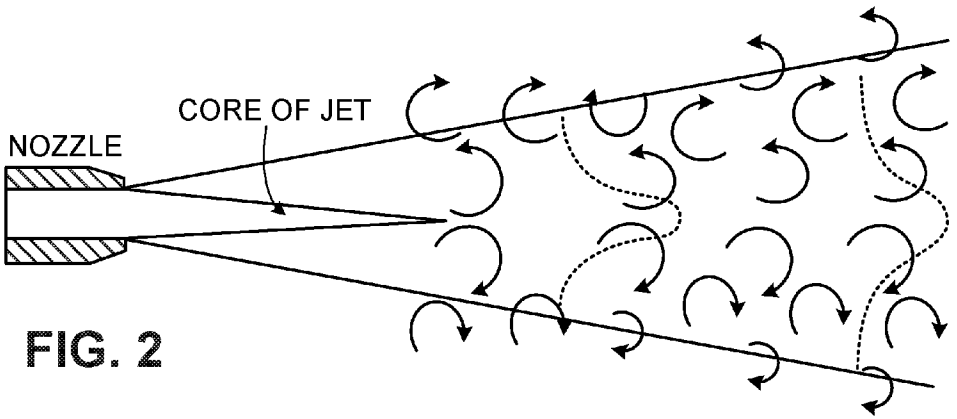
FIGS. 2 and 2A are diagrams illustrating jet flow exiting a nozzle.
Figure 2A:
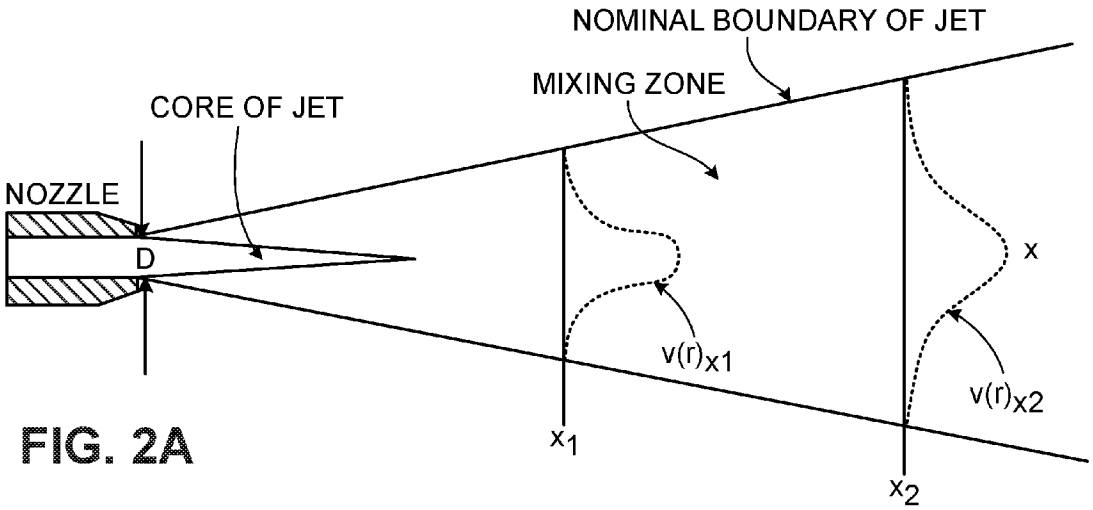

Referring to FIG. 2, the high velocity gradient between the core flow from a submerged jet and the surrounding fluid causes eddies. FIG. 2A illustrates the general characteristics of a submerged jet. As the submerged jet expands into the surrounding ambient environment the velocity profile flattens as the distance (x) from the nozzle increases. Also, the velocity gradient dv/dr changes with r (the distance from the centerline of the jet) at a given distance x, such that eddies are created which define the mixing zone (the conical expansion from the nozzle).

In an experimental study of a submerged jet in air (the results of which are applicable to any fluid, including water), Albertson et al. ("Diffusion of Submerged Jets," Paper 2409, Amer. Soc. of Civil Engineers Transactions, Vol. 115:639-697, 1950, at p. 657) developed dimensionless relationships for $v(x)_{r=0}/v_o$ (centerline velocity), $v(r)_x/v(x)_{r=0}$ (velocity profile at a given x), $Q_x/Q_o$ (flow entrainment), and $E_x/E_o$ (energy change with x):

(1) Centerline velocity, $v(x)_{r=0}/v_o$:

$$\frac{v(r=0)}{v_o}\frac{x}{D_o}=6.2$$

(2) velocity profile at any x, $v(r)_x/v(x)_{r=0}$:

$$\log\left[\frac{v(r)_x}{v_o}\frac{x}{D}\right]=0.79-33\frac{r^2}{x^2}$$

(3) Flow and energy at any x:

$$\frac{Q_x}{Q_o}=0.32\frac{^{20}x}{D_o} \tag{10.21}$$

$$\frac{E_x}{E_o}=4.1\frac{D_o}{x} \tag{10.22}$$

where:

v(r=0)=centerline velocity of submerged jet (m/s), $v_o$=velocity of jet as it emerges from the nozzle (m/s), x=distance from nozzle (m), r=distance from centerline of jet (m), $D_o$=diameter of nozzle (m), $Q_x$=flow of fluid across any given plane at distance x from the nozzle (me/s), $Q_o$=flow of fluid emerging from the nozzle (m3/s), E=energy flux of fluid across any given plane at distance x from the nozzle ($m^3$/s), $E_o$=energy flux of fluid emerging from the nozzle ($m^3$/s).

("Water Treatment Unit Processes: Physical and Chemical," David W. Hendricks, CRC Press 2006, p. 411.)

Jet mixing is particularly cost-effective in large-volume (over 1,000 gal) and low-viscosity (under 1,000 cPs) applications. It is also generally advantageous that in most cases a jet mixer has no moving parts submerged, e.g., when a pump is used it is generally located outside the vessel.

One advantage of jet mixing is that the temperature of the ambient fluid (other than directly adjacent the exit of the nozzle, where there may be some localized heating) is increased only slightly if at all. For example, the temperature may be increased by less than 5° C., less than 1° C., or not to any measurable extent.

Jet-Flow Agitators

Figure 3:
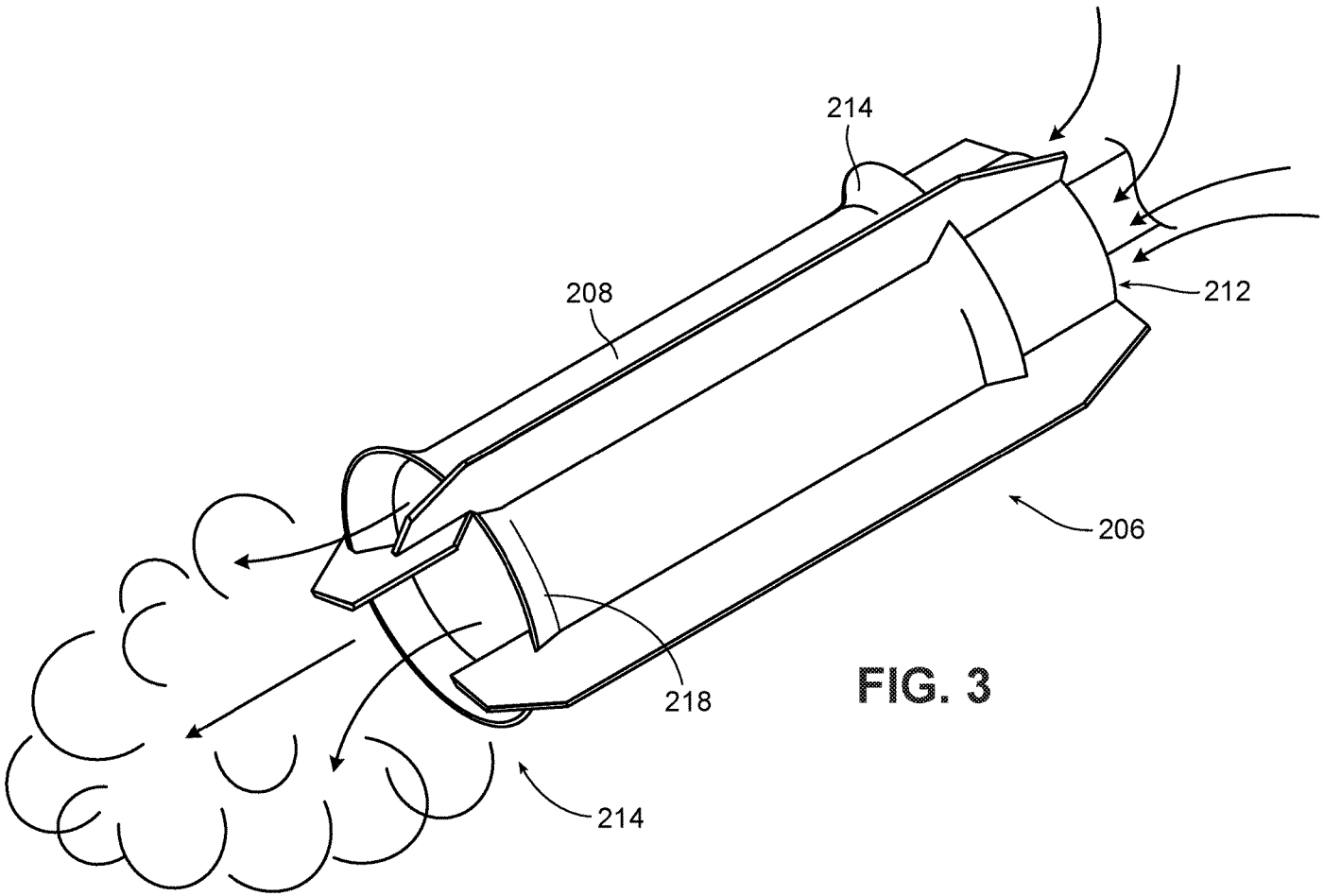
FIG. 3 is a diagrammatic perspective view of a jet-flow agitator according to one embodiment.
Figure 3A:
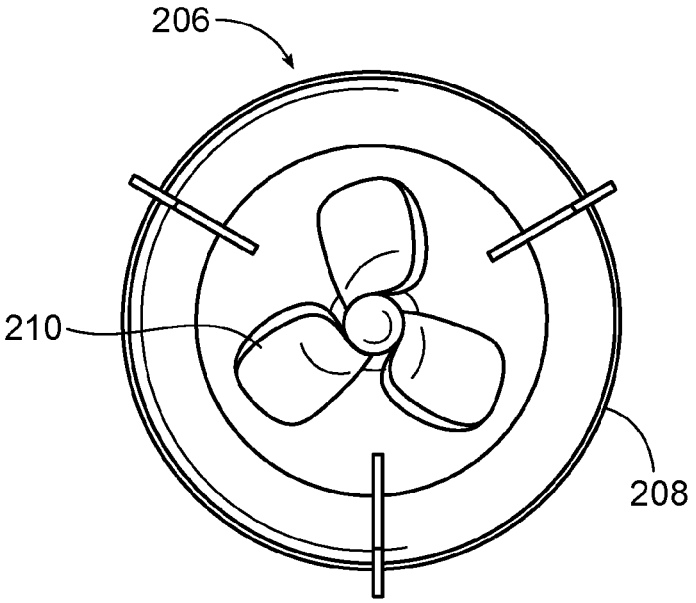
FIG. 3A is an enlarged perspective view of the impeller and jet tube of the jet-flow agitator of FIG. 3.

One type of jet-flow agitator is shown in FIGS. 3-3A. This type of mixer is available commercially, e.g., from IKA under the tradename ROTOTRON™. Referring to FIG. 3, the mixer 200 includes a motor 202, which rotates a drive shaft 204. A mixing element 206 is mounted at the end of the drive shaft 204. As shown in FIG. 3A, the mixing element 206 includes a shroud 208 and, within the shroud, an impeller 210. As indicated by the arrows, when the impeller is rotated in its "forward" direction, the impeller 210 draws liquid in through the open upper end 212 of the shroud and forces the liquid out through the open lower end 214. Liquid exiting end 214 is in the form of a high velocity stream or jet. If the direction of rotation of the impeller 210 is reversed, liquid can be drawn in through the lower end 214 and ejected through the upper end 212. This can be used, for example, to suck in solids that are floating near or on the surface of the liquid in a tank or vessel. (It is noted that "upper" and "lower" refer to the orientation of the mixer in FIG. 3; the mixer may be oriented in a tank so that the upper end is below the lower end.)

The shroud 208 includes flared areas 216 and 218 adjacent its ends. These flared areas are believed to contribute to the generally toroidal flow that is observed with this type of mixer. The geometry of the shroud and impeller also concentrate the flow into a high velocity stream using relatively low power consumption.

Preferably, the clearance between the shroud 208 and the impeller 210 is sufficient so as to avoid excessive milling of the material as it passes through the shroud. For example, the clearance may be at least 10 times the average particle size of the solids in the mixture, preferably at least 100 times.

In some implementations, the shaft 204 is configured to allow gas delivery through the shaft. For example, the shaft 204 may include a bore (not shown) through which gas is delivered, and one or more orifices through which gas exits into the mixture. The orifices may be within the shroud 208, to enhance mixing, and/or at other locations along the length of the shaft 204.

The impeller 210 may have any desired geometry that will draw liquid through the shroud at a high velocity. The impeller is preferably a marine impeller, as shown in FIG.

Figure 3B:
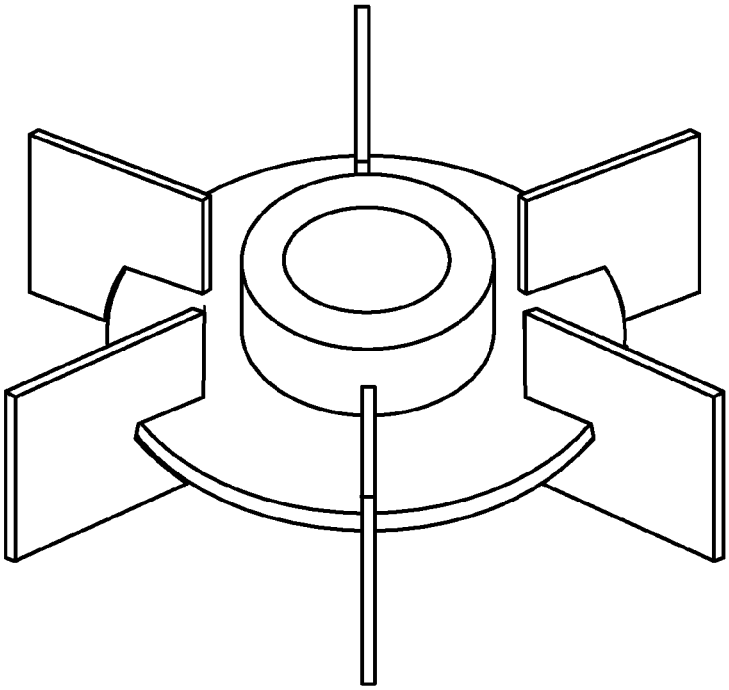
FIG. 3B is an enlarged perspective view of an alternate impeller.

3A, but may have a different design, for example, a Rushton impeller as shown in FIG. 3B, or a modified Rushton impeller, e.g., tilted so as to provide some axial flow.

In order to generate the high velocity flow through the shroud, the motor 202 is preferably a high speed, high torque motor, e.g., capable of operating at 500 to 20,000 RPM, e.g., 3,000 to 10,000 RPM. However, the larger the mixer (e.g., the larger the shroud and/or the larger the motor) the lower the rotational speed can be. Thus, if a large mixer is used, such as a 5 hp, 10 hp, 20 hp, or 30 hp or greater, the motor may be designed to operate at lower rotational speeds, e.g., less than 2000 RPM, less than 1500 RPM, or even 500 RPM or less. For example, a mixer sized to mix a 10,000-20,000 liter tank may operate at speeds of 900 to 1,200 RPM. The torque of the motor is preferably self-adjusting, to maintain a relatively constant impeller speed as the mixing conditions change over time.

Advantageously, the mixer can be oriented at any desired angle or location in the tank, to direct the jet flow in a desired direction. Moreover, as discussed above, depending on the direction of rotation of the impeller the mixer can be used to draw fluid from either end of the shroud.

In some implementations, two or more jet mixers are positioned in the vessel, with one or more being configured to jet fluid upward ("up pump") and one or more being configured to jet fluid downward ("down pump"). In some cases, an up pumping mixer will be positioned adjacent a down pumping mixer, to enhance the turbulent flow created by the mixers. If desired, one or more mixers may be switched between upward flow and downward flow during processing. It may be advantageous to switch all or most of the mixers to up pumping mode during initial dispersion of the feedstock in the liquid medium, as up pumping creates significant turbulence at the surface.

Suction Chamber Jet Mixers

Another type of jet mixer includes a primary nozzle that delivers a pressurized fluid from a pump, a suction inlet adjacent the primary nozzle through which ambient fluid is drawn by the pressure drop between the primary nozzle and the wider inlet, and a suction chamber extending between the suction inlet and a secondary nozzle. A jet of high velocity fluid exits the secondary nozzle.

Figure 4:
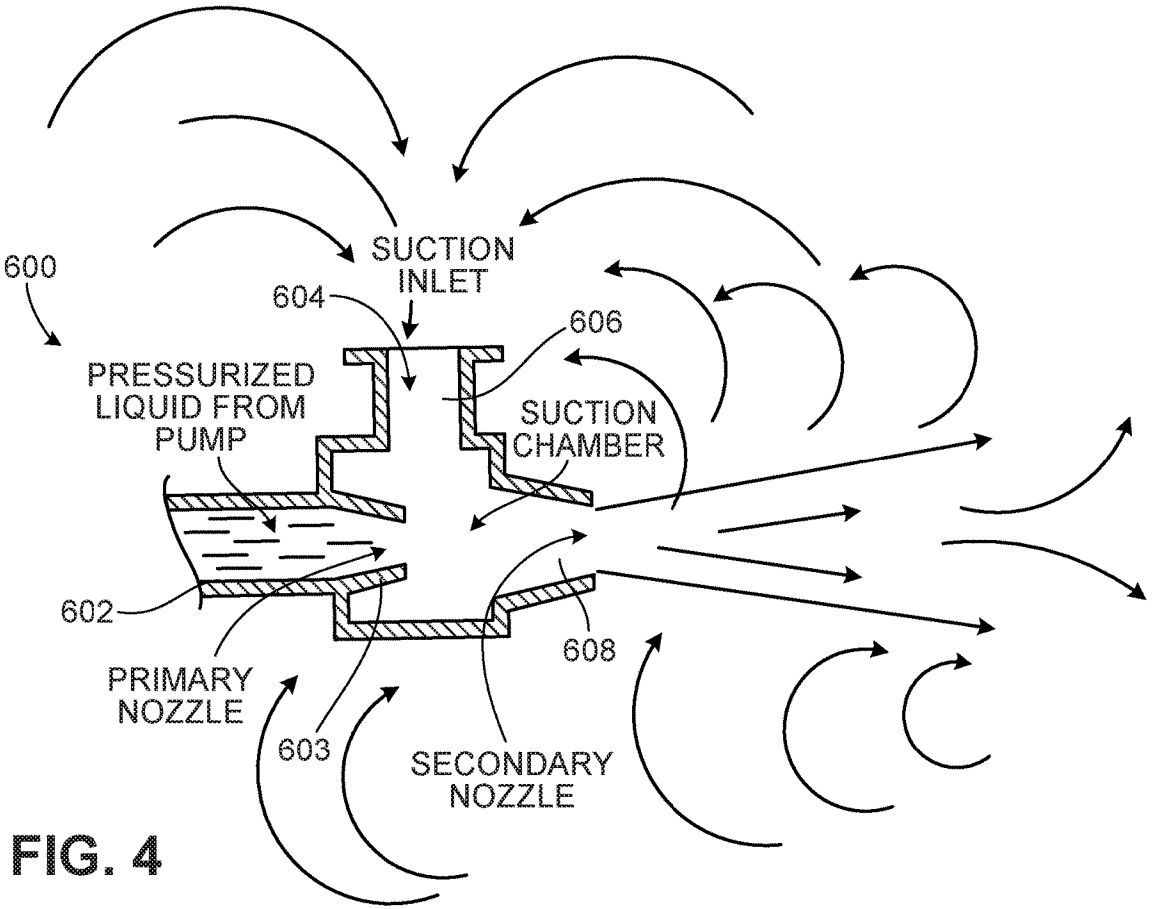
FIG. 4 is a diagram of a suction chamber jet mixing nozzle according to one embodiment.

An example of this type of mixer is shown in FIG. 4. As shown, in mixer 600 pressurized liquid from a pump (not shown) flows through an inlet passage 602 and exits through a primary nozzle 603. Ambient liquid is drawn through a suction inlet 604 into suction chamber 606 by the pressure drop caused by the flow of pressurized liquid. The combined flow exits from the suction chamber into the ambient liquid at high velocity through secondary nozzle 608. Mixing occurs both in the suction chamber and in the ambient liquid due to the jet action of the exiting jet of liquid.

Figure 4A:
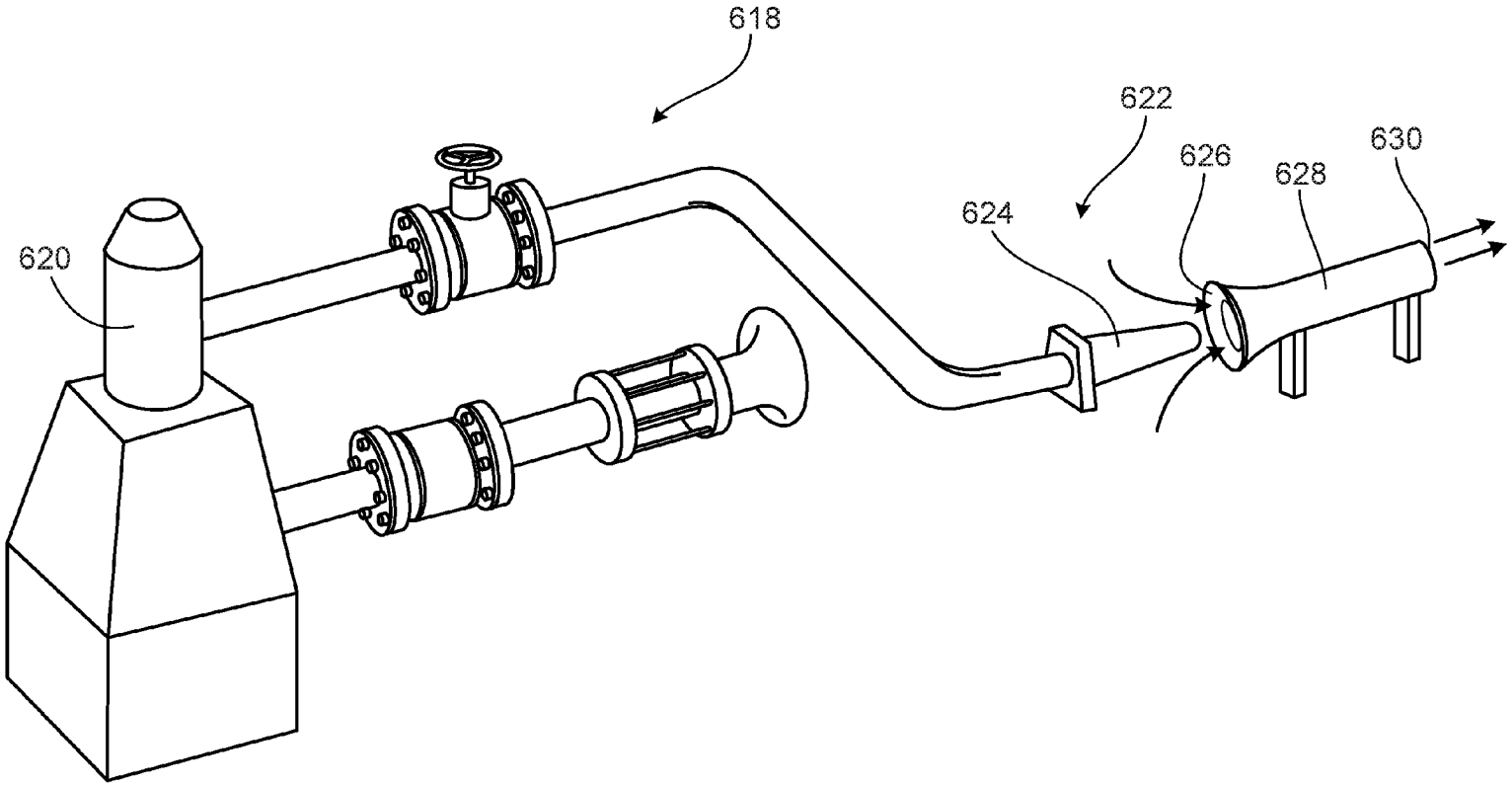
FIG. 4A is a perspective view of a suction chamber jet mixing system according to another embodiment.

A mixing system that operates according to a similar principle is shown in FIG. 4A. Mixers embodying this design are commercially available from ITT Water and Wastewater, under the tradename Flygt™ jet mixers. In system 618, pump 620 generates a primary flow that is delivered to the tank (not shown) through a suction nozzle system 622. The suction nozzle system 622 includes a primary nozzle 624 which functions in a manner similar to primary nozzle 603 described above, causing ambient fluid to be drawn into the adjacent open end 626 of ejector tube 628 due to the pressure drop induced by the fluid exiting the primary nozzle. The combined flow then exits the other end 630 of ejector tube 628, which functions as a secondary nozzle, as a high velocity jet.

Figure 5:
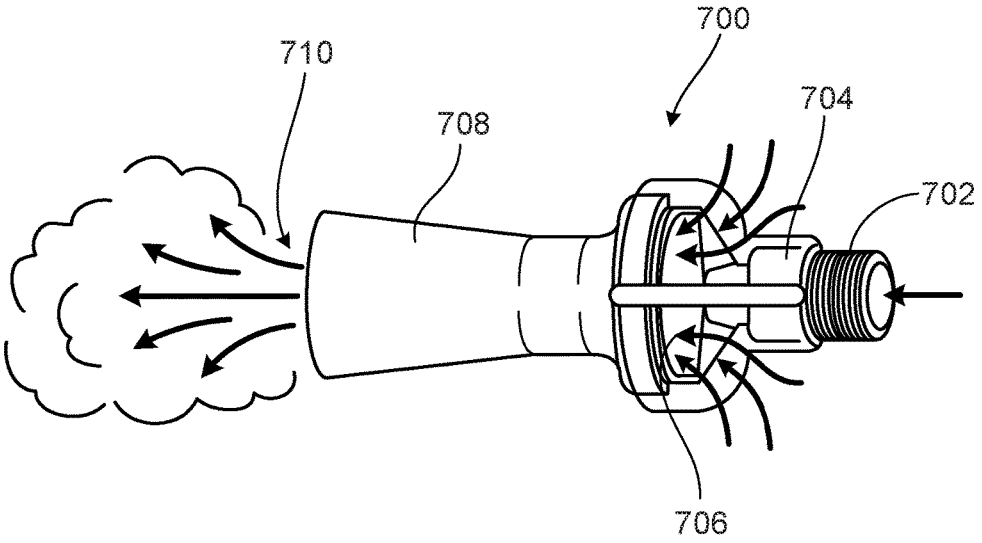
FIG. 5 is a diagrammatic perspective view of a jet mixing nozzle for a suction chamber jet mixing system according to another alternate embodiment.

The nozzle shown in FIG. 5, referred to as an eductor nozzle, operates under a similar principle. A nozzle embodying this design is commercially available under the tradename TeeJet®. As shown, in nozzle 700 pressurized liquid flows in through an inlet 702 and exits a primary nozzle 704, drawing ambient fluid in to the open end 706 of a diffuser 708. The combined flow exits the opposite open end 710 of the diffuser at a circulation flow rate A+B that is the sum of the inlet flow rate A and the flow rate B of the entrained ambient fluid.

Jet Aeration Type Mixers

Another type of jet mixing system that can be utilized is referred to in the wastewater industry as "jet aeration mixing." In the wastewater industry, these mixers are typically used to deliver a jet of a pressurized air and liquid mixture, to provide aeration. However, in the present application in some cases the jet aeration type mixers are utilized without pressurized gas, as will be discussed below. The principles of operation of jet aeration mixers will be initially described in the context of their use with pressurized gas, for clarity.

Figure 6:
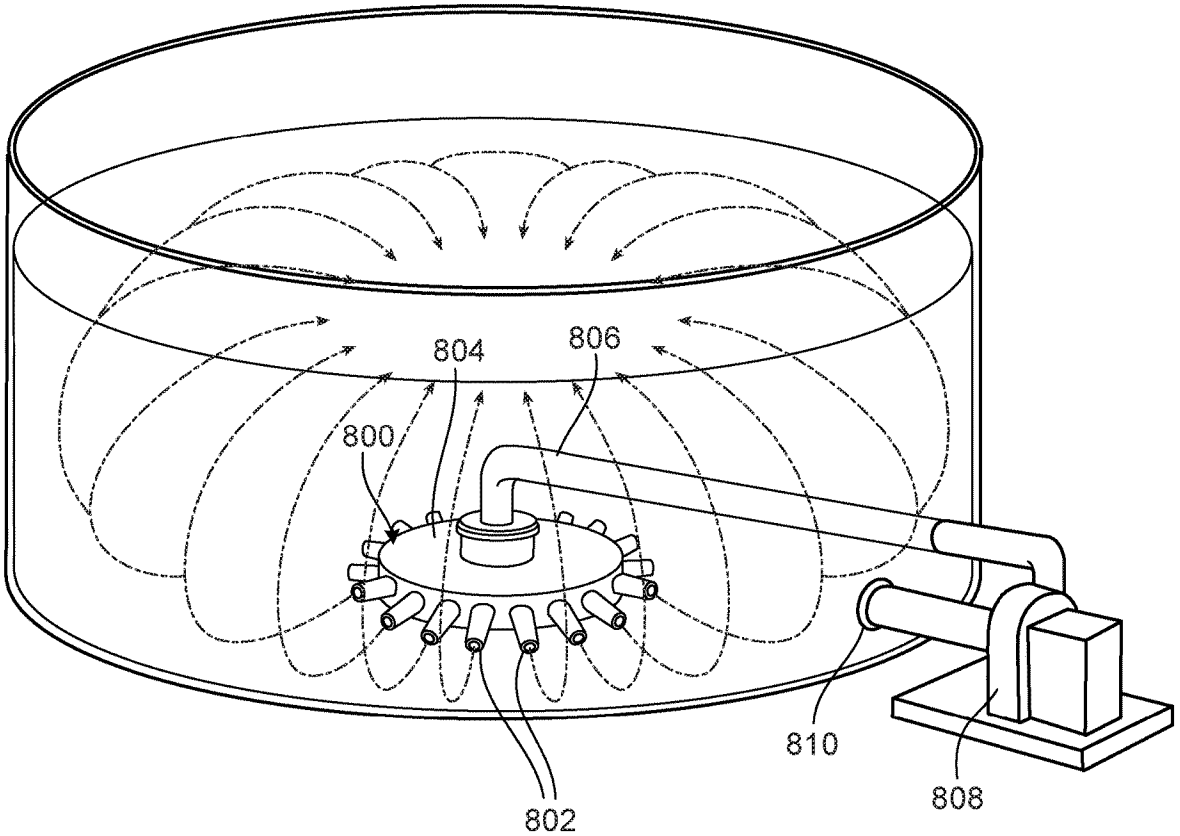
FIG. 6 is a diagrammatic perspective view of a tank and a jet aeration type mixing system positioned in the tank, with the tank being shown as transparent to allow the jet mixer and associated piping to be seen.
Figure 6A:
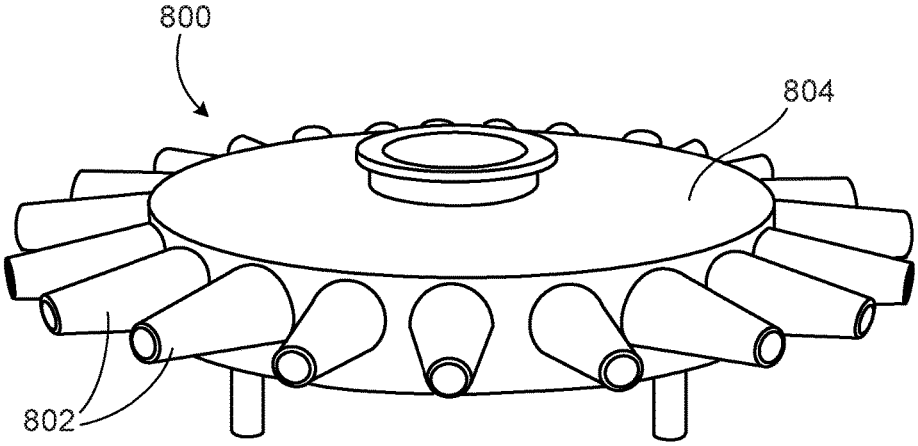
FIG. 6A is a perspective view of the jet mixer used in the jet aeration system of FIG. 6.
Figure 6B:
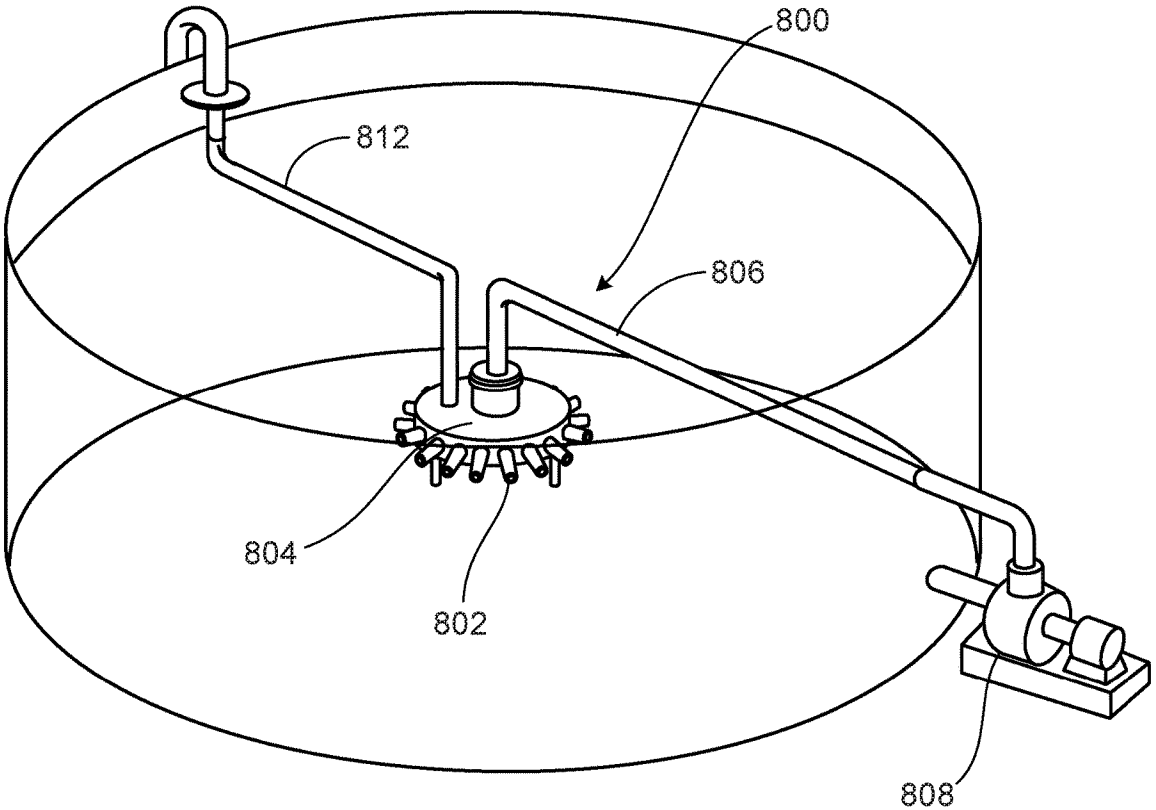
FIG. 6B is a diagrammatic perspective view of a similar system in which an air intake is provided.

An eddy jet mixer, such as the mixer 800 shown in FIGS. 6-6B, includes multiple jets 802 mounted in a radial pattern on a central hub 804. The radial pattern of the jets uniformly distributes mixing energy throughout the tank. The eddy jet mixer may be centrally positioned in a tank, as shown to provide toroidal flow about the center axis of the tank. The eddy jet mixer may be mounted on piping 806, which supplies high velocity liquid to the eddy jet mixer. In the embodiment shown in FIG. 6B, air is also supplied to the eddy jet mixer through piping 812. The high velocity liquid is delivered by a pump 808 which is positioned outside of the tank and which draws liquid in through an inlet 810 in the side wall of the tank.

Figure 7:
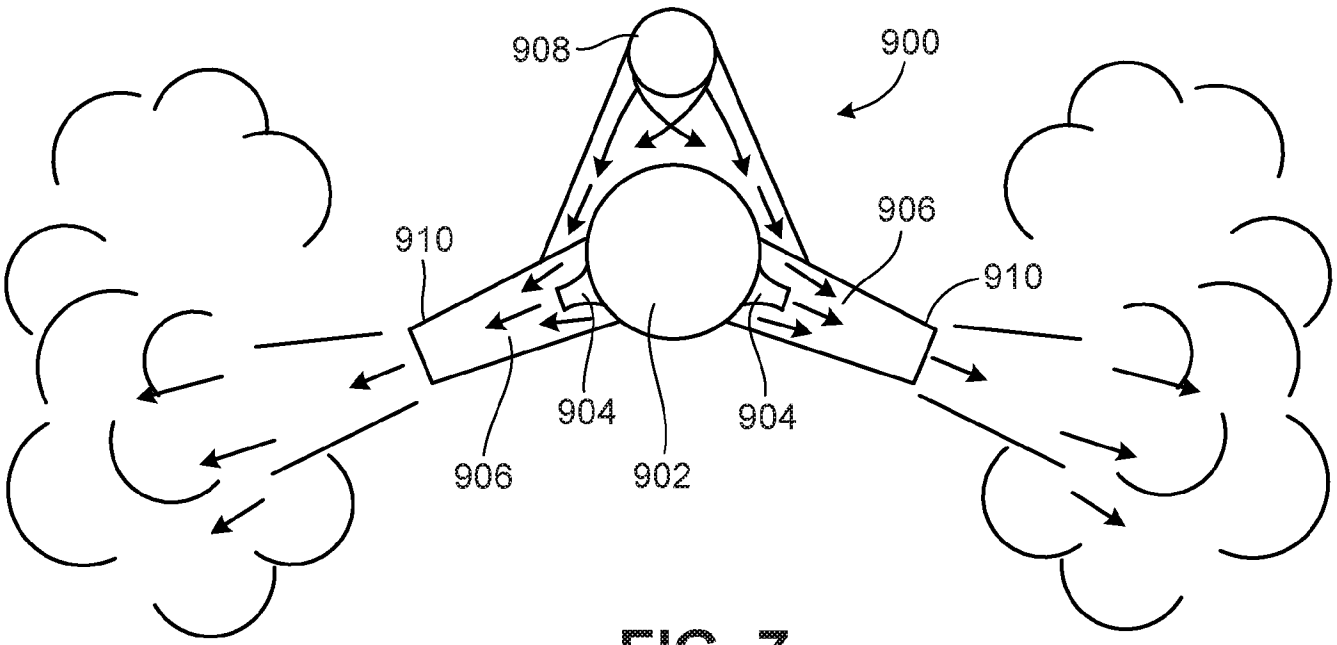
FIG. 7 is a cross-sectional view of a jet aeration type mixer according to one embodiment.
Figure 8:
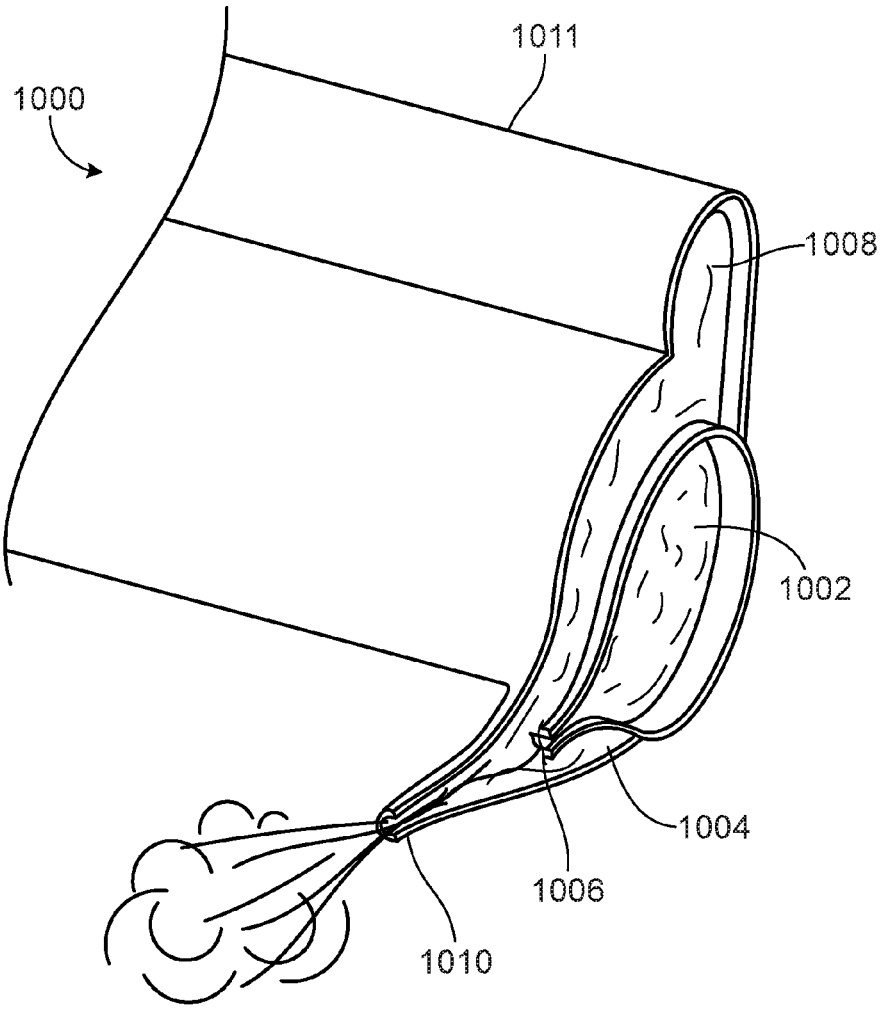
FIG. 8 is a cross-sectional view of a jet aeration type mixer according to an alternate embodiment.

FIGS. 7 and 8 show two types of nozzle configurations that are designed to mix a gas and a liquid stream and eject a high velocity jet. These nozzles are configured somewhat differently from the eddy jet mixer shown in FIGS. 6 and 6A but function in a similar manner. In the system 900 shown in FIG. 7, a primary or motive fluid is directed through a liquid line 902 to inner nozzles 904 through which the liquid travels at high velocity into a mixing area 906. A second fluid, e.g., a gas, such as compressed air, nitrogen or carbon dioxide, or a liquid, enters the mixing area through a second line 908 and entrained in the motive fluid entering the mixing area 906 through the inner nozzles. In some instances the second fluid is nitrogen or carbon dioxide so as to reduce oxidation of the enzyme. The combined flow from the two lines is jetted into the mixing tank through the outer nozzles 910. If the second fluid is a gas, tiny bubbles are entrained in the liquid in the mixture. Liquid is supplied to the liquid line 902 by a pump. Gas, if it is used, is provided by compressors. If a liquid is used as the second fluid, it can have the same velocity as the liquid entering through the liquid line 902, or a different velocity.

FIG. 8 shows an alternate nozzle design 1000, in which outer nozzles 1010 (of which only one is shown) are positioned along the length of an elongated member 1011 that includes a liquid line 1002 that is positioned parallel to a second line 1008. Each nozzle includes a single outer nozzle 1010 and a single inner nozzle 1004. Mixing of the motive liquid with the second fluid proceeds in the same manner as in the system 900 described above.

Figure 9:
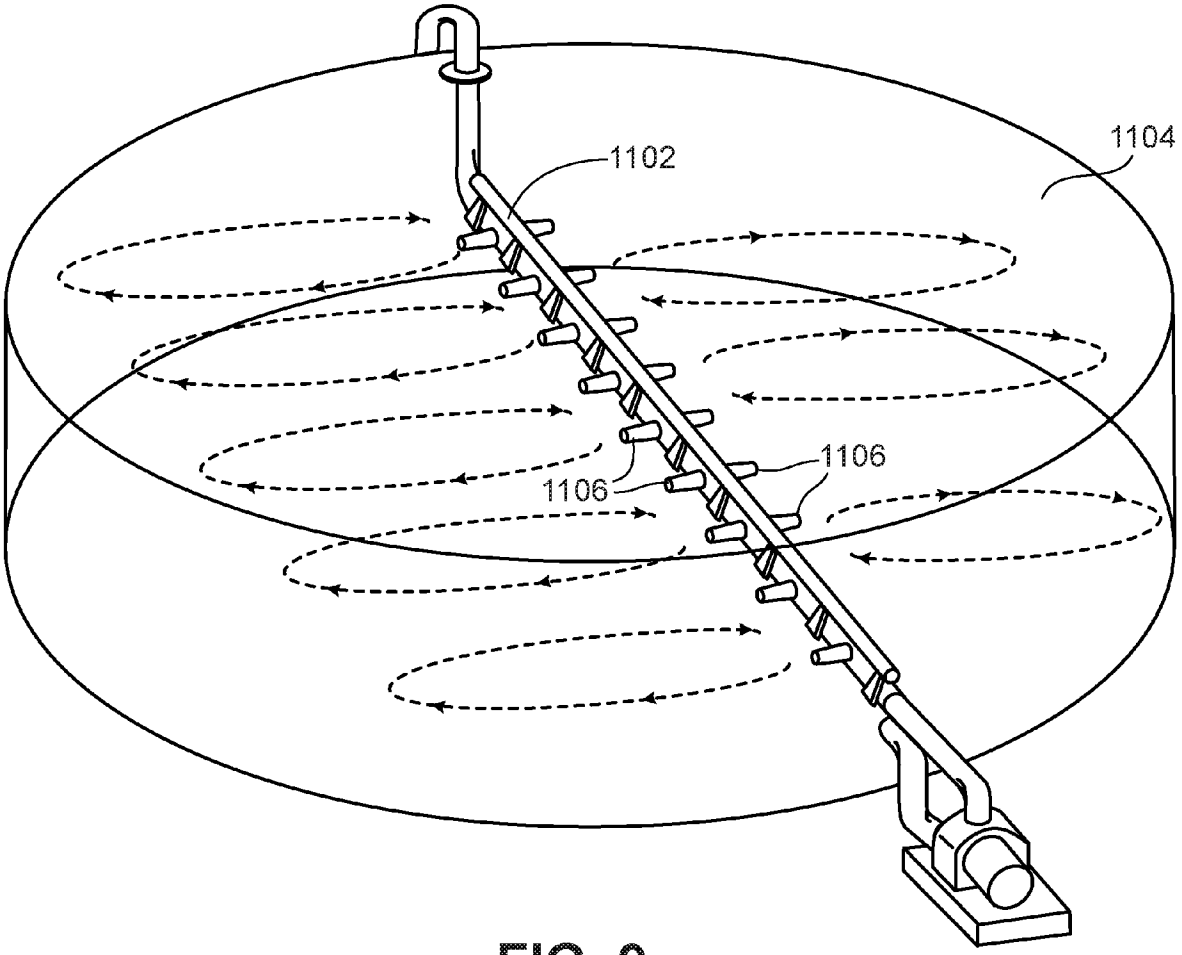
FIGS. 9-11 are diagrams illustrating alternative flow patterns in tanks containing different configurations of jet mixers.
Figure 10:
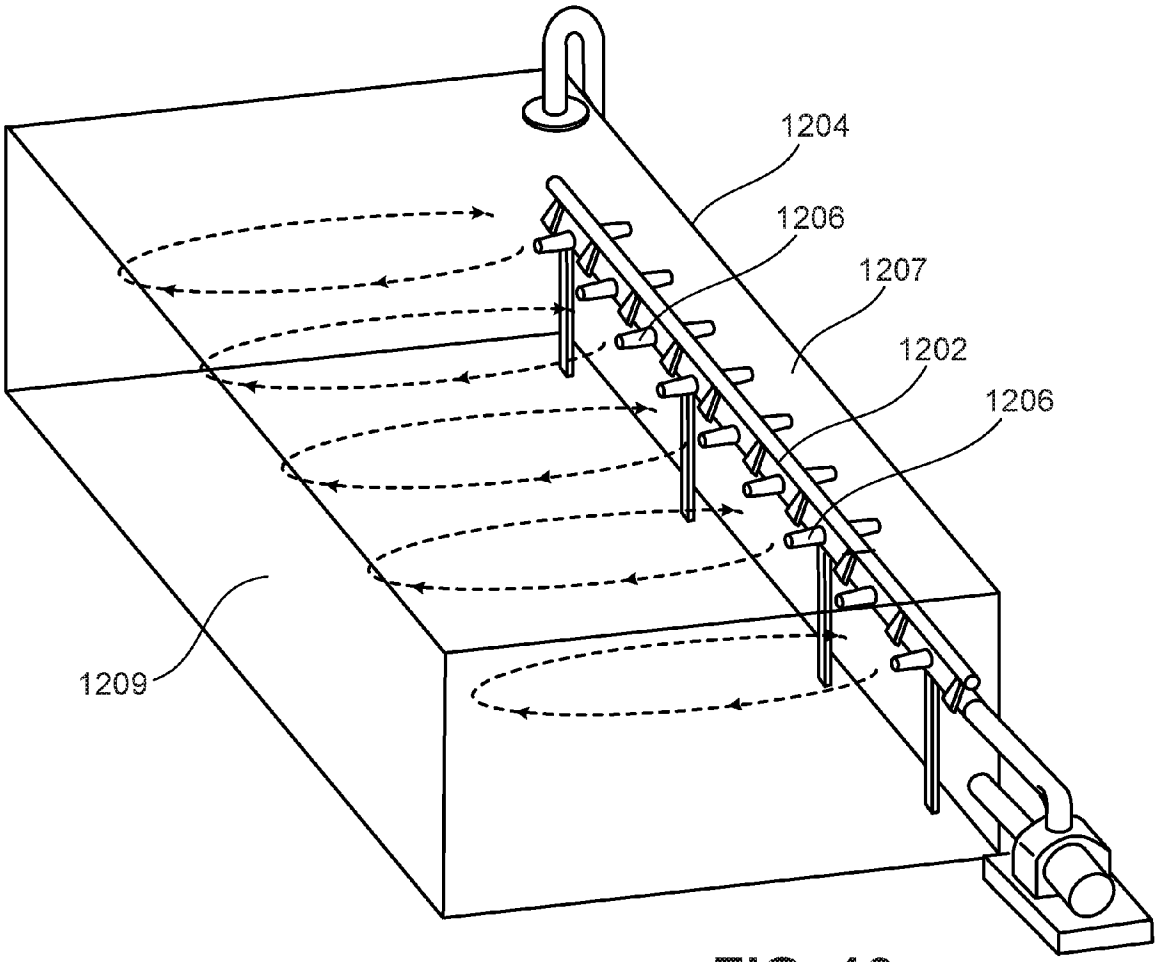

FIGS. 9 and 10 illustrate examples of jet aeration type mixing systems in which nozzles are positioned along the length of an elongated member. In the example shown in FIG. 9, the elongated member 1102 is positioned along the diameter of the tank 1104, and the nozzles 1106 extend in opposite directions from the nozzle to produce the indicated flow pattern which includes two areas of generally elliptical flow, one on either side of the central elongated member. In the example shown in FIG. 10, the tank 1204 is generally rectangular in cross section, and the elongated member 1202 extends along one side wall 1207 of the tank. In this case, the nozzles 1206 all face in the same direction, towards the opposite side wall 1209. This produces the flow pattern shown, in which flow in the tank is generally elliptical about a major axis extending generally centrally along the length of the tank. In the embodiment shown in FIG. 10, the nozzles may be canted towards the tank floor, e.g., at an angle of from about 15 to 30 degrees from the horizontal.

Figure 11:
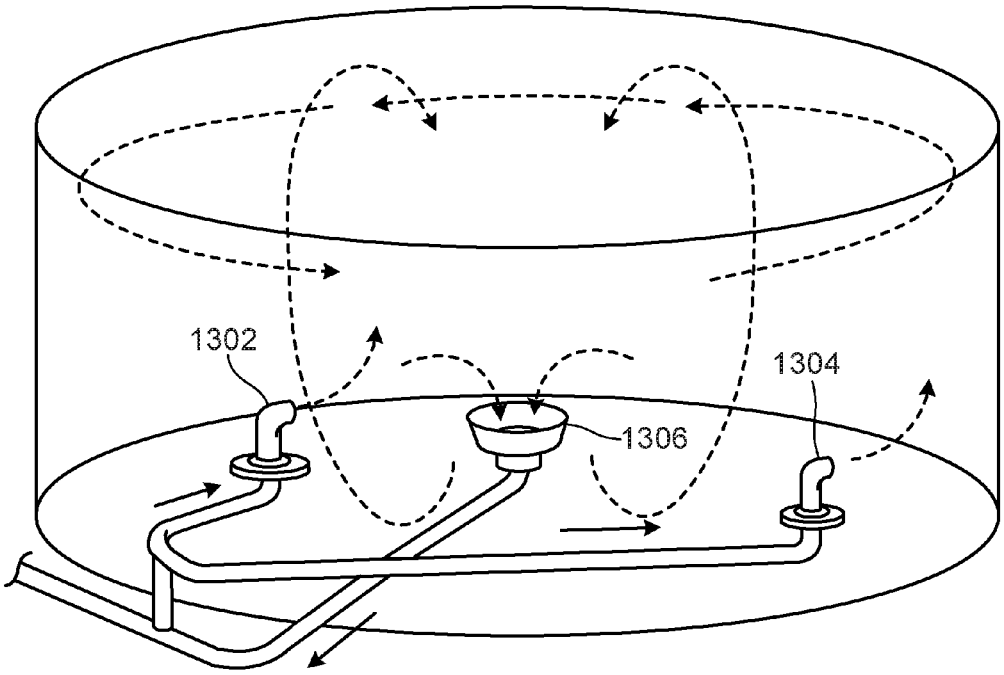

In another embodiment, shown in FIG. 11, the nozzles 1302, 1304, and suction inlet 1306 are arranged to cause the contents of the tank to both revolve and rotate in a toroidal, rolling donut configuration around a central vertical axis of the tank. Flow around the surface of the toroid is drawn down the tank center, along the floor, up the walls and back to the center, creating a rolling helix pattern, which sweeps the center and prevents solids from settling. The toroidal pattern is also effective in moving floating solids to the tank center where they are pulled to the bottom and become homogenous with the tank contents. The result is a continuous helical flow pattern, which minimizes tank dead spots.

Backflushing

Figure 12:
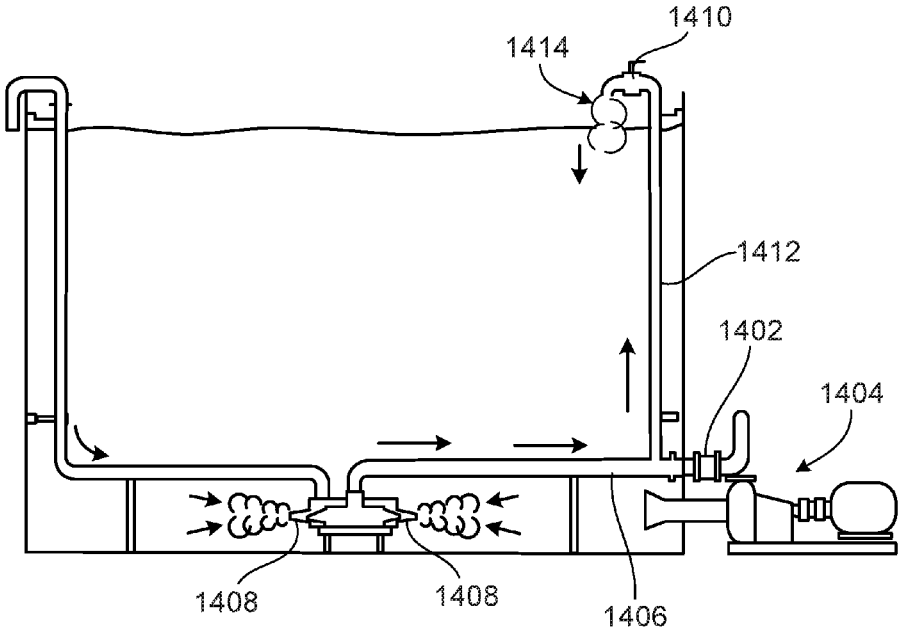
FIG. 12 is a diagram illustrating the flow pattern that occurs in a tank during backflushing according to one embodiment.

In some instances, the jet nozzles described herein can become plugged, which may cause efficiency and cost effectiveness to be reduced. Plugging of the nozzles may be removed by reversing flow of the motive liquid through the nozzle. For example, in the system shown in FIG. 12, this is accomplished by closing a valve 1402 between the pump 1404 and the liquid line 1406 flowing to the nozzles 1408, and activating a secondary pump 1410. Secondary pump 1410 draws fluid in through the nozzles. The fluid then travels up through vertical pipe 1412 due to valve 1402 being closed. The fluid exits the vertical pipe 1412 at its outlet 1414 for recirculation through the tank.

Mixing in Transit/Portable Mixers

In some cases processing can take place in part or entirely during transportation of the mixture, e.g., between a first processing plant for treating the feedstock and a second processing plant for production of a final product. In this case, mixing can be conducted using a jet mixer designed for rail car or other portable use. The mixer can be operated using a control system that is external to the tank, which may include for example a motor and a controller configured to control the operation of the mixer. Venting (not shown) may also be provided.

Minimizing Hold Up on Tank Walls

In some situations, in particular at solids levels approaching a theoretical or practical limit, material may accumulate along the side wall and/or bottom wall of the tank during mixing. This phenomenon, referred to as "hold up," is undesirable as it can result in inadequate mixing. Several approaches can be taken to minimize hold up and ensure good mixing throughout the tank.

Figure 14:
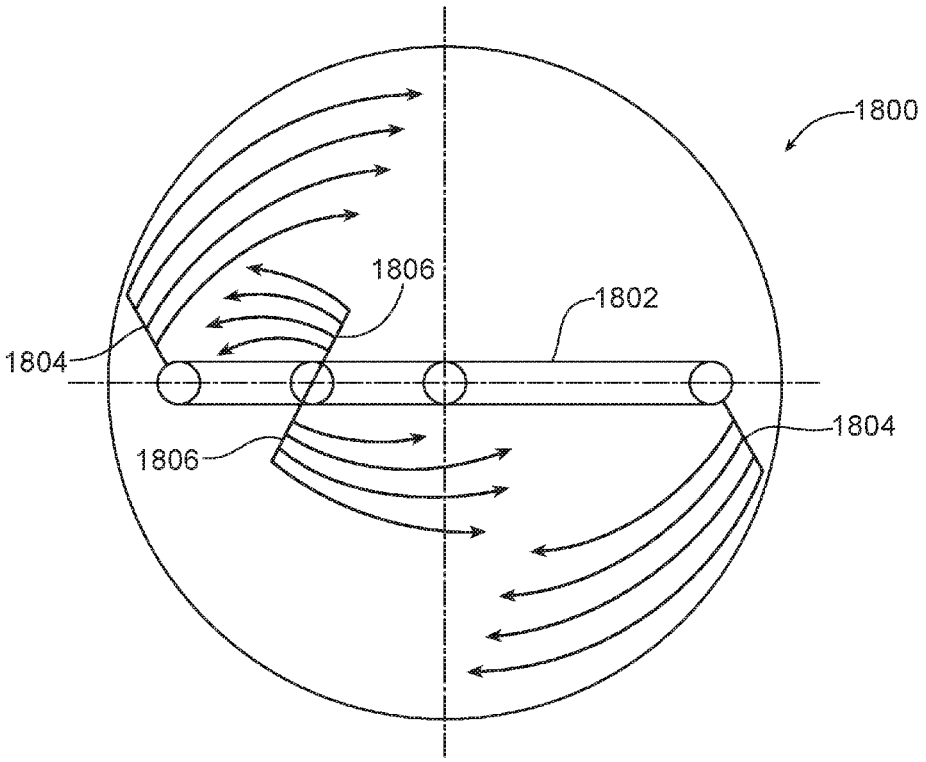
FIGS. 14 and 14A are a diagrammatic top view and a perspective view, respectively, of a device that minimizes hold up along the walls of a tank during mixing.
Figure 14A:
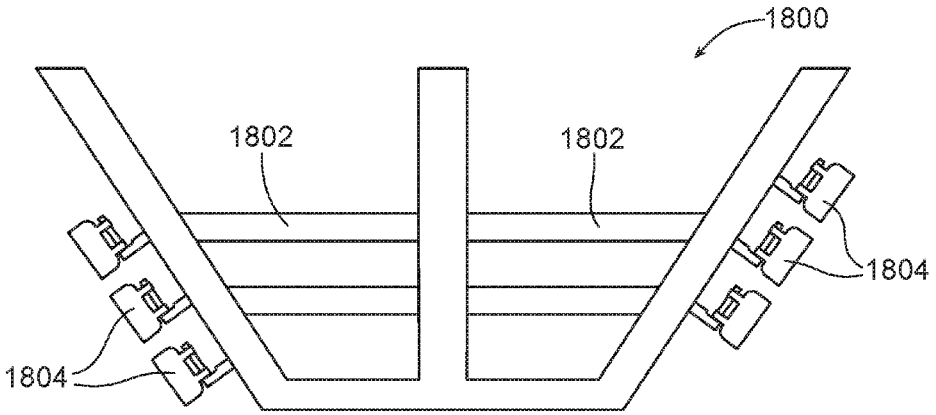

For example, in addition to the jet mixing device(s), the tank can be outfitted with a scraping device, for example a device having a blade that scrapes the side of the tank in a "squeegee" manner. Such devices are well known, for example in the dairy industry. Suitable agitators include the side and bottom sweep agitators and scraper blade agitators manufactured by Walker Engineered Products, New Lisbon, Wis. As shown in FIG. 14, a side and bottom sweep agitator 1800 may include a central elongated member 1802, mounted to rotate about the axis of the tank. Side wall scraper blades 1804 are mounted at each end of the elongated member 1802 and are disposed at an angle with respect to the elongated member. In the embodiment shown, a pair of bottom wall scraper blades 1806 are mounted at an intermediate point on the elongated member 1802, to scrape up any material accumulating on the tank bottom. These scrapers may be omitted if material is not accumulating on the tank bottom. As shown in FIG. 14A, the scraper blades 1804 may be in the form of a plurality of scraper elements positioned along the side wall. In other embodiments, the scraper blades are continuous, or may have any other desired geometry.

In other embodiments, the jet mixer itself is configured so as to minimize hold up. For example, the jet mixer may include one or more movable heads and/or flexible portions that move during mixing. For example, the jet mixer may include an elongated rotatable member having a plurality of jet nozzles along its length. The elongated member may be planar, as shown in FIG. 15, or have a non-planar shape, e.g., it may conform to the shape of the tank walls as shown in FIG. 16.

Figure 15:
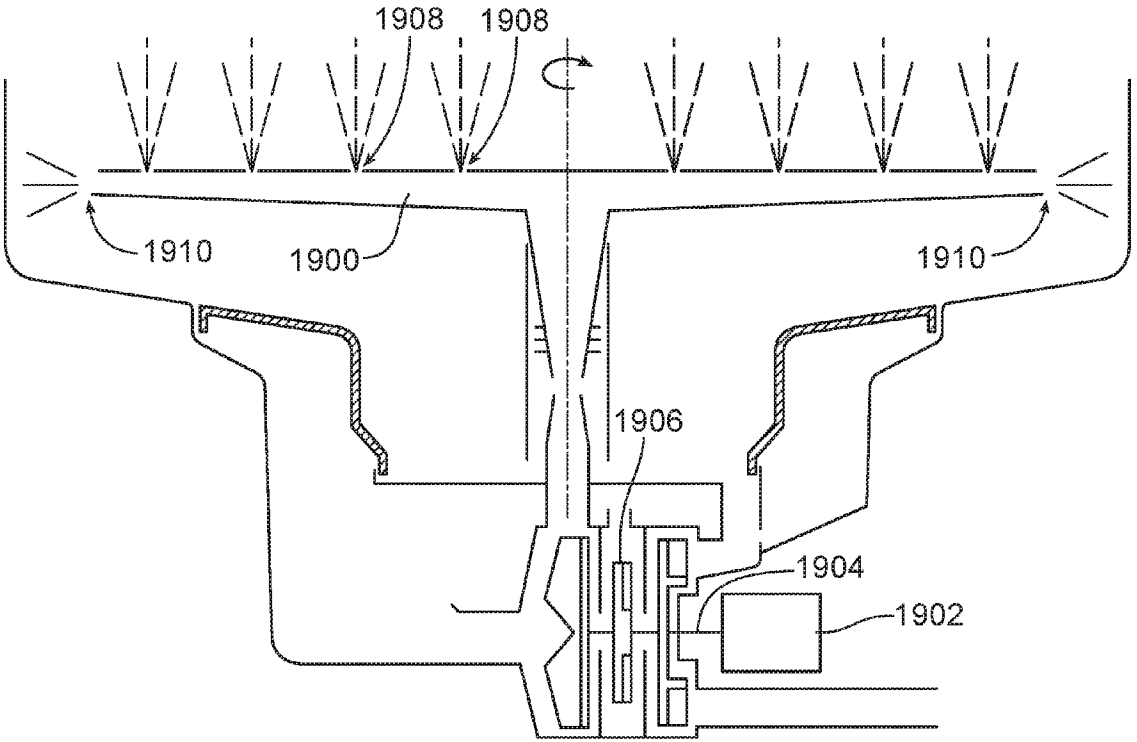
FIGS. 15 and 16 are views of water jet devices that provide mixing while also minimizing hold up along the tank walls.

Referring to FIG. 15, the jet mixer nozzles may be positioned on a rotating elongated member 1900 that is driven by a motor 1902 and shaft 1904. Water or other fluid is pumped through passageways in the rotating member, e.g., by a pump impeller 1906, and exits as a plurality of jets through jet orifices 1908 while the member 1900 rotates. To reduce hold up on the tank side walls, orifices 1910 may be provided at the ends of the member 1900.

Figure 16:
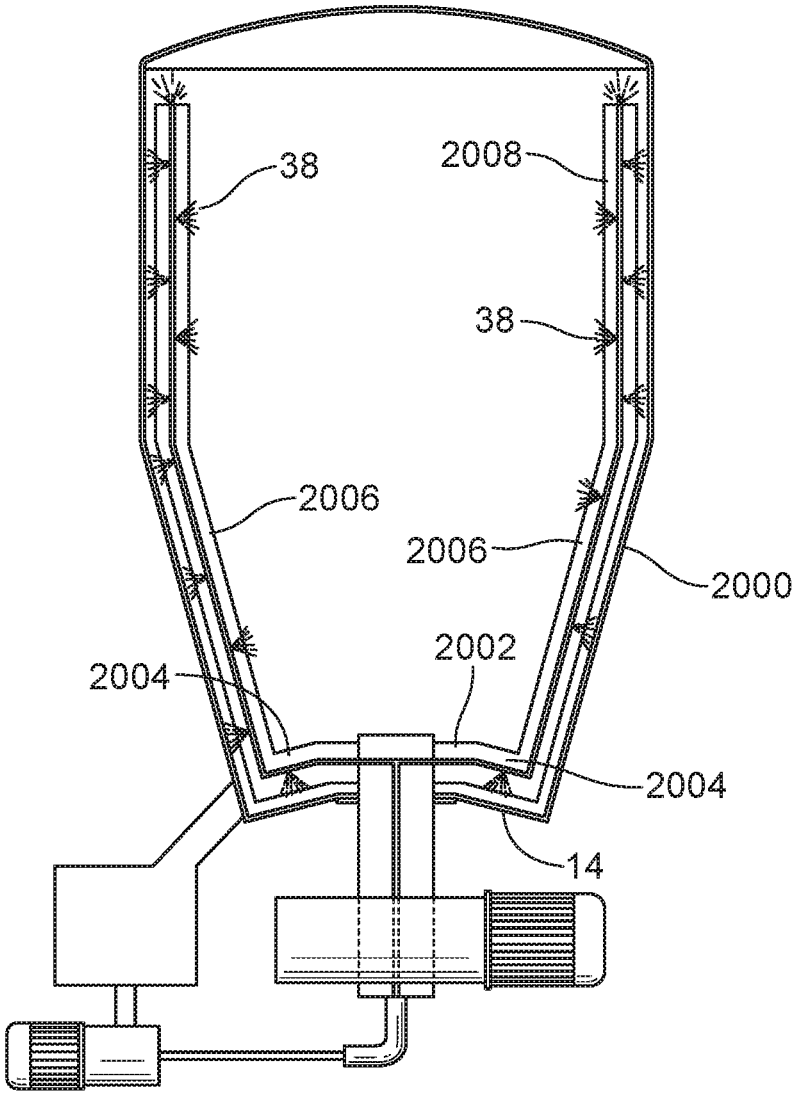

In the embodiment shown in FIG. 16, to conform to the particular shape of the tank 2000 the elongated member includes horizontally extending arms 2002, downwardly inclined portions 2004, outwardly and upwardly inclined portions 2006, and vertically extending portions 2008. Fluid is pumped through passageways within the elongated member to a plurality of jet orifices 38, through which jets are emitted while the elongated member is rotated.

In both of the embodiments shown in FIGS. 15 and 16, the jets provide mixing while also washing down the side walls of the tank.

In some implementations, combinations of the embodiments described above may be used. For example, combinations of planar and non-planar rotating or oscillating elongated members may be used. The moving nozzle arrangements described above can be used in combination with each other and/or in combination with scrapers. A plurality of moving nozzle arrangements can be used together, for example two or more of the rotating members shown in FIG. 15 can be stacked vertically in the tank. When multiple rotating members are used, they can be configured to rotate in the same direction or in opposite directions, and at the same speed or different speeds.

Physical Treatment of Feedstock

In some implementations, the feedstock is physically treated, e.g., to change its molecular structure. Physical treatment processes can include one or more of any of those described herein, such as mechanical treatment, chemical treatment, irradiation, sonication, oxidation, pyrolysis or steam explosion. Treatment methods can be used in combinations of two, three, four, or even all of these technologies (in any order). When more than one treatment method is used, the methods can be applied at the same time or at different times. Other processes that change a molecular structure of a feedstock may also be used, alone or in combination with the processes disclosed herein.

Mechanical Treatments

In some cases, methods can include a mechanical treatment. Mechanical treatments include, for example, cutting, milling, pressing, grinding, shearing and chopping. Milling may include, for example, ball milling, hammer milling, rotor/stator dry or wet milling, or other types of milling. Other mechanical treatments include, e.g., stone grinding, cracking, mechanical ripping or tearing, pin grinding or air attrition milling.

In some implementations, the feedstock material can first be physically treated by one or more of the other physical treatment methods, e.g., chemical treatment, radiation, sonication, oxidation, pyrolysis or steam explosion, and then mechanically treated. This sequence can be advantageous since materials treated by one or more of the other treatments, e.g., irradiation or pyrolysis, tend to be more brittle and, therefore, it may be easier to further change the molecular structure of the material by mechanical treatment.

Feed preparation systems can be configured to produce streams with specific characteristics such as, for example, specific maximum sizes or specific surface areas.

Radiation Treatment

Irradiation can reduce the molecular weight and/or crystallinity of feedstock. In some embodiments, energy deposited in a material that releases an electron from its atomic orbital is used to irradiate the materials. The radiation may be provided by 1) heavy charged particles, such as alpha particles or protons, 2) electrons, produced, for example, in beta decay or electron beam accelerators, or 3) electromagnetic radiation, for example, gamma rays, x rays, or ultraviolet rays. In one approach, radiation produced by radioactive substances can be used to irradiate the feedstock. In some embodiments, any combination in any order or concurrently of (1) through (3) may be utilized. In another approach, electromagnetic radiation (e.g., produced using electron beam emitters) can be used to irradiate the feedstock. The doses applied depend on the desired effect and the particular feedstock. For example, high doses of radiation can break chemical bonds within feedstock components. In some instances when chain scission is desirable and/or polymer chain functionalization is desirable, particles heavier than electrons, such as protons, helium nuclei, argon ions, silicon ions, neon ions, carbon ions, phosphorus ions, oxygen ions or nitrogen ions can be utilized. When ring-opening chain scission is desired, positively charged particles can be utilized for their Lewis acid properties for enhanced ring-opening chain scission. For example, when maximum oxidation is desired, oxygen ions can be utilized, and when maximum nitration is desired, nitrogen ions can be utilized.

Ionizing Radiation

Each form of radiation ionizes the carbon-containing material via particular interactions, as determined by the energy of the radiation. Heavy charged particles primarily ionize matter via Coulomb scattering; furthermore, these interactions produce energetic electrons that may further ionize matter. Alpha particles are identical to the nucleus of a helium atom and are produced by the alpha decay of various radioactive nuclei, such as isotopes of bismuth, polonium, astatine, radon, francium, radium, several actinides, such as actinium, thorium, uranium, neptunium, curium, californium, americium, and plutonium.

When particles are utilized, they can be neutral (uncharged), positively charged or negatively charged. When charged, the charged particles can bear a single positive or negative charge, or multiple charges, e.g., one, two, three or even four or more charges. In instances in which chain scission is desired, positively charged particles may be desirable, in part due to their acidic nature. When particles are utilized, the particles can have the mass of a resting electron, or greater, e.g., 500, 1000, 1500, 2000, 10,000 or even 100,000 times the mass of a resting electron. For example, the particles can have a mass of from about 1 atomic unit to about 150 atomic units, e.g., from about 1 atomic unit to about 50 atomic units, or from about 1 to about 25, e.g., 1, 2, 3, 4, 5, 10, 12 or 15 amu. Accelerators used to accelerate the particles can be electrostatic DC, electrodynamic DC, RF linear, magnetic induction linear or continuous wave. For example, cyclotron type accelerators are available from IBA, Belgium, such as the Rhodotron® system, while DC type accelerators are available from RDI, now IBA Industrial, such as the Dynamitron®. Ions and ion accelerators are discussed in Introductory Nuclear Physics, Kenneth S. Krane, John Wiley & Sons, Inc. (1988), Krsto Prelec, FIZIKA B 6 (1997) 4, 177-206, Chu, William T., "Overview of Light-Ion Beam Therapy" Columbus-Ohio, ICRU-IAEA Meeting, 18-20 Mar. 2006, Iwata, Y. et al., "Alternating-Phase-Focused IH-DTL for Heavy-Ion Medical Accelerators" Proceedings of EPAC 2006, Edinburgh, Scotland and Leaner, C. M. et al., "Status of the Superconducting ECR Ion Source Venus" Proceedings of EPAC 2000, Vienna, Austria.

Gamma radiation has the advantage of a significant penetration depth into a variety of materials. Sources of gamma rays include radioactive nuclei, such as isotopes of cobalt, calcium, technicium, chromium, gallium, indium, iodine, iron, krypton, samarium, selenium, sodium, thalium, and xenon.

Sources of x rays include electron beam collision with metal targets, such as tungsten or molybdenum or alloys, or compact light sources, such as those produced commercially by Lyncean.

Sources for ultraviolet radiation include deuterium or cadmium lamps.

Sources for infrared radiation include sapphire, zinc, or selenide window ceramic lamps.

Sources for microwaves include klystrons, Slevin type RF sources, or atom beam sources that employ hydrogen, oxygen, or nitrogen gases.

In some embodiments, a beam of electrons is used as the radiation source. A beam of electrons has the advantages of high dose rates (e.g., 1, 5, or even 10 Mrad per second), high throughput, less containment, and less confinement equipment. Electrons can also be more efficient at causing chain scission. In addition, electrons having energies of 4-10 MeV can have a penetration depth of 5 to 30 mm or more, such as 40 mm.

Electron beams can be generated, e.g., by electrostatic generators, cascade generators, transformer generators, low energy accelerators with a scanning system, low energy accelerators with a linear cathode, linear accelerators, and pulsed accelerators. Electrons as an ionizing radiation source can be useful, e.g., for relatively thin piles of materials, e.g., less than 0.5 inch, e.g., less than 0.4 inch, 0.3 inch, 0.2 inch, or less than 0.1 inch. In some embodiments, the energy of each electron of the electron beam is from about 0.3 MeV to about 2.0 MeV (million electron volts), e.g., from about 0.5 MeV to about 1.5 MeV, or from about 0.7 MeV to about 1.25 MeV.

Electron beam irradiation devices may be procured commercially from Ion Beam Applications, Louvain-la-Neuve, Belgium or the Titan Corporation, San Diego, Calif. Typical electron energies can be 1 MeV, 2 MeV, 4.5 MeV, 7.5 MeV, or 10 MeV. Typical electron beam irradiation device power can be 1 kW, 5 kW, 10 kW, 20 kW, 50 kW, 100 kW, 250 kW, or 500 kW. The level of depolymerization of the feedstock depends on the electron energy used and the dose applied, while exposure time depends on the power and dose. Typical doses may take values of 1 kGy, 5 kGy, 10 kGy, 20 kGy, 50 kGy, 100 kGy, or 200 kGy.

Ion Particle Beams

Particles heavier than electrons can be utilized to irradiate hydrocarbon-containing materials. For example, protons, helium nuclei, argon ions, silicon ions, neon ions carbon ions, phosphorus ions, oxygen ions or nitrogen ions can be utilized. In some embodiments, particles heavier than electrons can induce higher amounts of chain scission (relative to lighter particles). In some instances, positively charged particles can induce higher amounts of chain scission than negatively charged particles due to their acidity.

Heavier particle beams can be generated, e.g., using linear accelerators or cyclotrons. In some embodiments, the energy of each particle of the beam is from about 1.0 MeV/atomic unit to about 6,000 MeV/atomic unit, e.g., from about 3 MeV/atomic unit to about 4,800 MeV/atomic unit, or from about 10 MeV/atomic unit to about 1,000 MeV/atomic unit.

In certain embodiments, ion beams can include more than one type of ion. For example, ion beams can include mixtures of two or more (e.g., three, four or more) different types of ions. Exemplary mixtures can include carbon ions and protons, carbon ions and oxygen ions, nitrogen ions and protons, and iron ions and protons. More generally, mixtures of any of the ions discussed above (or any other ions) can be used to form irradiating ion beams. In particular, mixtures of relatively light and relatively heavier ions can be used in a single ion beam.

In some embodiments, ion beams for irradiating materials include positively-charged ions. The positively charged ions can include, for example, positively charged hydrogen ions (e.g., protons), noble gas ions (e.g., helium, neon, argon), carbon ions, nitrogen ions, oxygen ions, silicon atoms, phosphorus ions, and metal ions such as sodium ions, calcium ions, and/or iron ions. Without wishing to be bound by any theory, it is believed that such positively-charged ions behave chemically as Lewis acid moieties when exposed to materials, initiating and sustaining cationic ring-opening chain scission reactions in an oxidative environment.

In certain embodiments, ion beams for irradiating materials include negatively-charged ions. Negatively charged ions can include, for example, negatively charged hydrogen ions (e.g., hydride ions), and negatively charged ions of various relatively electronegative nuclei (e.g., oxygen ions, nitrogen ions, carbon ions, silicon ions, and phosphorus ions). Without wishing to be bound by any theory, it is believed that such negatively-charged ions behave chemically as Lewis base moieties when exposed to materials, causing anionic ring-opening chain scission reactions in a reducing environment.

In some embodiments, beams for irradiating materials can include neutral atoms. For example, any one or more of hydrogen atoms, helium atoms, carbon atoms, nitrogen atoms, oxygen atoms, neon atoms, silicon atoms, phosphorus atoms, argon atoms, and iron atoms can be included in beams that are used for irradiation of hydrocarbon-containing materials. In general, mixtures of any two or more of the above types of atoms (e.g., three or more, four or more, or even more) can be present in the beams.

In certain embodiments, ion beams used to irradiate materials include singly-charged ions such as one or more of $H^+$, $H^-$, $He^+$, $Ne^+$, $Ar^+$, $C^+$, $C^-$, $O^+$, $O^-$, $N^+$, $N^-$, $Si^+$, $Si^+$, $P^+$, $P^-$, $Na^+$, $Ca^+$, and $Fe^+$. In some embodiments, ion beams can include multiply-charged ions such as one or more of $C^{2+}$, $C^{3+}$, $C^{4+}$, $N^{3+}$, $N^{5+}$, $N^{3-}$, $O^{2+}$, $O^{2-}$, $O_2^{2-}$, $Si^{2+}$, $Si^{4+}$, $Si^{2-}$, and $Si^{4-}$. In general, the ion beams can also include more complex polynuclear ions that bear multiple positive or negative charges. In certain embodiments, by virtue of the structure of the polynuclear ion, the positive or negative charges can be effectively distributed over substantially the entire structure of the ions. In some embodiments, the positive or negative charges can be somewhat localized over portions of the structure of the ions.

Electromagnetic Radiation

In embodiments in which the irradiating is performed with electromagnetic radiation, the electromagnetic radiation can have, e.g., energy per photon (in electron volts) of greater than $10^2$ eV, e.g., greater than $10^3$, $10^4$, $10^5$, $10^6$, or even greater than $10^7$ eV. In some embodiments, the electromagnetic radiation has energy per photon of between $10^4$ and $10^7$, e.g., between $10^5$ and $10^6$ eV. The electromagnetic radiation can have a frequency of, e.g., greater than $10^{16}$ Hz, greater than $10^{17}$ Hz, $10^{18}$, $10^{19}$, $10^{20}$, or even greater than $10^{21}$ Hz. In some embodiments, the electromagnetic radiation has a frequency of between $10^{18}$ and $10^{22}$ Hz, e.g., between $10^{19}$ to $10^{21}$ Hz.

Doses

In some embodiments, the irradiating (with any radiation source or a combination of sources) is performed until the material receives a dose of at least 0.25 Mrad, e.g., at least 1.0 Mrad, at least 2.5 Mrad, at least 5.0 Mrad, or at least 10.0 Mrad. In some embodiments, the irradiating is performed until the material receives a dose of between 1.0 Mrad and 6.0 Mrad, e.g., between 1.5 Mrad and 4.0 Mrad.

In some embodiments, the irradiating is performed at a dose rate of between 5.0 and 1500.0 kilorads/hour, e.g., between 10.0 and 750.0 kilorads/hour or between 50.0 and 350.0 kilorads/hours.

In some embodiments, two or more radiation sources are used, such as two or more ionizing radiations. For example, samples can be treated, in any order, with a beam of electrons, followed by gamma radiation and UV light having wavelengths from about 100 nm to about 280 nm. In some embodiments, samples are treated with three ionizing radiation sources, such as a beam of electrons, gamma radiation, and energetic UV light.

Sonication, Pyrolysis and Oxidation

In addition to radiation treatment, the feedstock may be treated with any one or more of sonication, pyrolysis and oxidation. These treatment processes are described in U.S. Ser. No. 12/417,840, the disclosure of which is incorporated by reference herein.

Other Processes

Any of the processes of this paragraph can be used alone without any of the processes described herein, or in combination with any of the processes described herein (in any order): steam explosion, acid treatment (including concentrated and dilute acid treatment with mineral acids, such as sulfuric acid, hydrochloric acid and organic acids, such as trifluoroacetic acid), base treatment (e.g., treatment with lime or sodium hydroxide), UV treatment, screw extrusion treatment (see, e.g., U.S. Patent Application Ser. No. 61/073,530, filed Nov. 18, 2008, solvent treatment (e.g., treatment with ionic liquids) and freeze milling (see, e.g., U.S. Patent Application Ser. No. 61/081,709).

Other Embodiments

A number of embodiments have been described. Nevertheless, it will be understood that various modifications may be made without departing from the spirit and scope of the disclosure.

For example, the jet mixers described herein can be used in any desired combination, and/or in combination with other types of mixers.

Figure 13:
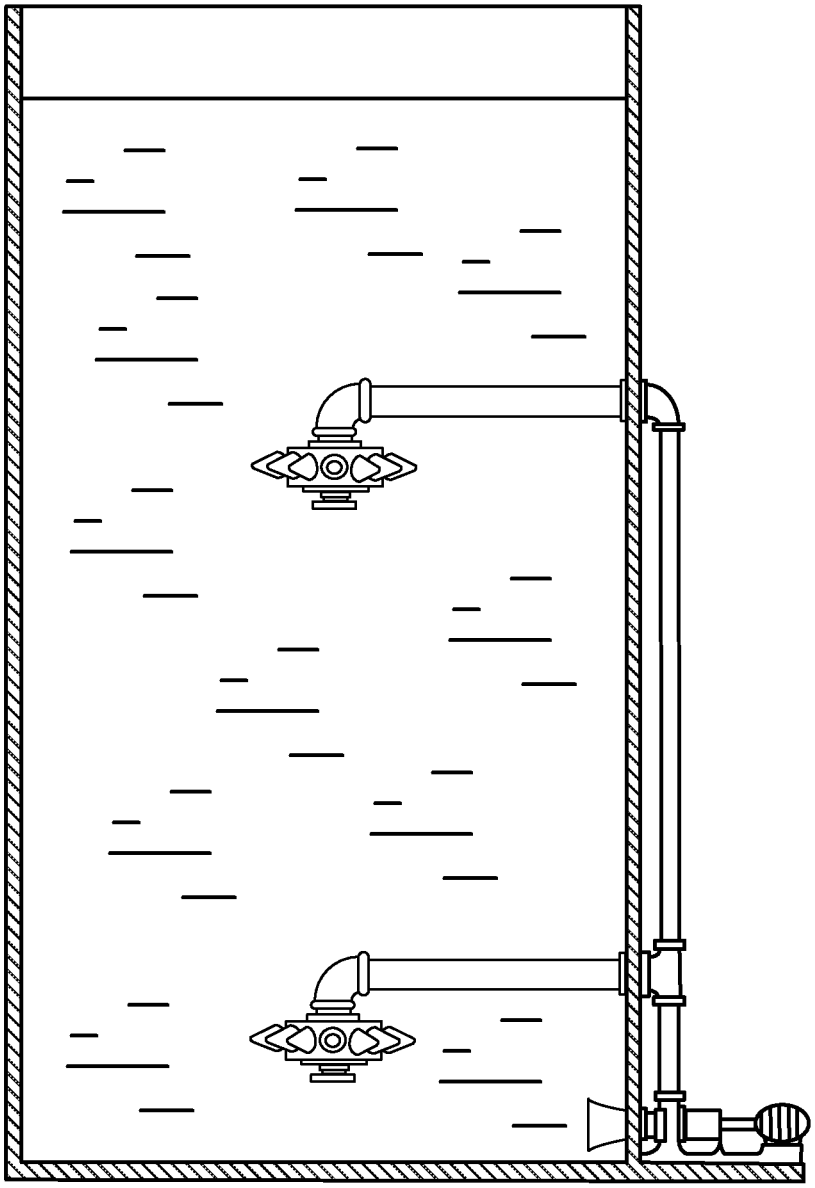
FIG. 13 is a side view of a jet aeration type system according to another embodiment, showing a multi-level arrangement of nozzles in a tank.

The jet mixer(s) may be mounted in any desired position within the tank. With regard to shaft-mounted jet mixers, the shaft may be collinear with the center axis of the tank or may be offset therefrom. For example, if desired the tank may be provided with a centrally mounted mixer of a different type, e.g., a marine impeller or Rushton impeller, and a jet mixer may be mounted in another area of the tank either offset from the center axis or on the center axis. In the latter case one mixer can extend from the top of the tank while the other extends upward from the floor of the tank. Moreover, as shown in FIG. 13, two or more jet mixers can be mounted in a multi-level arrangement at different heights within the tank.

In any of the jet mixing systems described herein, the flow of fluid (liquid and/or gas) through the jet mixer can be continuous or pulsed, or a combination of periods of continuous flow with intervals of pulsed flow. When the flow is pulsed, pulsing can be regular or irregular. In the latter case, the motor that drives the fluid flow can be programmed, for example to provide pulsed flow at intervals to prevent mixing from becoming "stuck." The frequency of pulsed flow can be, for example, from about 0.5 Hz to about 10 Hz, e.g., about 0.5 Hz, 0.75 Hz, 1.0 Hz, 2.0 Hz, 5 Hz, or 10 Hz. Pulsed flow can be provided by turning the motor on and off, and/or by providing a flow diverter that interrupts flow of the fluid.

While tanks have been referred to herein, jet mixing may be used in any type of vessel or container, including lagoons, pools, ponds and the like. If the container in which mixing takes place is an in-ground structure such as a lagoon, it may be lined. The container may be covered, e.g., if it is outdoors, or uncovered.

While hydrocarbon-containing feedstocks have been described herein, other feedstocks and mixtures of hydrocarbon-containing feedstocks with other feedstocks may be used. For example, some implementations may utilize mixtures of hydrocarbon-containing feedstocks with biomass feedstocks such as those disclosed in U.S. Provisional Application No. 61/218,832, filed Jun. 19, 2009, the full disclosure of which is incorporated by reference herein.

Accordingly, other embodiments are within the scope of the following claims.

What is claimed is:

1. A feedstock processing apparatus comprising:

a tank, a feedstock delivery device configured to deliver a hydrocarbon-containing feedstock to the tank, and a jet mixer that comprises a plurality of jet flow agitators each including an impeller mounted at a distal end of a shaft, and a shroud surrounding the impeller, the jet flow agitators each having a nozzle disposed within the tank and agitating the delivered feedstock with a fluid medium in the tank under jet flow conditions, and the jet flow agitators are configured to jet fluid upward during initial dispersion of the hydrocarbon-containing feedstock in a liquid medium within the tank.

2. The apparatus of claim 1 wherein the jet mixer further comprises a motor within each jet flow agitator, and the apparatus further comprises a torque monitor that monitors torque of the motor during mixing.

3. The apparatus of claim 1 wherein the tank has an arcuate bottom.

4. The apparatus of claim 1 further comprising a preprocessing module configured to irradiate the hydrocarbon-containing feedstock prior to delivery to the tank.

5. The apparatus of claim 2 further comprising a controller that adjusts the operation of the feedstock delivery device based on input from the torque-monitoring device.

6. The apparatus of claim 1 further comprising a cooling module configured to cool the hydrocarbon-containing feedstock.

7. The apparatus of claim 1 wherein the jet flow agitators are further configured to switch between upward jet fluid flow and downward jet fluid flow during processing of the hydrocarbon-containing feedstock in the liquid medium within the tank.

* * * * *